US011384304B2

(12) United States Patent
Morris et al.

(10) Patent No.: US 11,384,304 B2
(45) **Date of Patent: *Jul. 12, 2022**

(54) METHOD AND ADDITIVE FOR CONTROLLING NITROGEN OXIDE EMISSIONS

(71) Applicant: ADA-ES, INC., Highlands Ranch, CO (US)

(72) Inventors: William J. Morris, Evergreen, CO (US); Kenneth E. Baldrey, Denver, CO (US); Constance Senior, Littleton, CO (US); Ramon Bisque, Golden, CO (US)

(73) Assignee: ADA-ES, Inc., Highlands Ranch, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/917,270

(22) Filed: Jun. 30, 2020

(65) Prior Publication Data

US 2020/0332213 A1 Oct. 22, 2020

Related U.S. Application Data

(60) Continuation of application No. 15/941,522, filed on Mar. 30, 2018, now Pat. No. 10,767,130, which is a (Continued)

(51) Int. Cl.
*C10L 5/32* (2006.01)
*F23J 7/00* (2006.01)
(Continued)

(52) U.S. Cl.
CPC ..... *C10L 5/32* (2013.01); *C10L 9/10* (2013.01); *C10L 10/00* (2013.01); *F23J 7/00* (2013.01);
(Continued)

(58) Field of Classification Search
CPC ..... C10L 10/00; C10L 2200/0204; C10L 2200/0259; C10L 2200/029;
(Continued)

(56) References Cited

U.S. PATENT DOCUMENTS 208,011 A 9/1878 Eaton
224,649 A 2/1880 Child
(Continued)

FOREIGN PATENT DOCUMENTS

CA 1067835 12/1979
CA 1099490 4/1981
(Continued)

OTHER PUBLICATIONS

U.S. Appl. No. 17/068,579, filed Oct. 12, 2020, Sjostrom et al.
(Continued)

*Primary Examiner* — Latosha Hines
(74) *Attorney, Agent, or Firm* — Sheridan Ross P.C.

(57) ABSTRACT

The present disclosure is directed to an additive mixture and method for controlling nitrogen oxide(s) by adding the additive mixture to a feed material prior to combustion.

24 Claims, 2 Drawing Sheets

Related U.S. Application Data division of application No. 13/964,441, filed on Aug. 12, 2013, now Pat. No. 9,957,454.

(60) Provisional application No. 61/792,827, filed on Mar. 15, 2013, provisional application No. 61/724,634, filed on Nov. 9, 2012, provisional application No. 61/704,290, filed on Sep. 21, 2012, provisional application No. 61/682,040, filed on Aug. 10, 2012.

(51) Int. Cl.
*C10L 9/10* (2006.01)
*C10L 10/00* (2006.01)

(52) U.S. Cl.
CPC . *C10L 2200/0204* (2013.01); *C10L 2200/029* (2013.01); *C10L 2200/0259* (2013.01); *C10L 2230/04* (2013.01); *C10L 2290/02* (2013.01); *C10L 2290/06* (2013.01); *C10L 2290/24* (2013.01); *F23K 2201/505* (2013.01)

(58) Field of Classification Search
CPC ..... C10L 2230/04; C10L 2290/02; C10L 2290/06; C10L 2290/24; C10L 5/32; C10L 9/10; F23J 7/00; F23K 2201/505
See application file for complete search history.

(56) References Cited

U.S. PATENT DOCUMENTS 346,765 A 8/1886 McIntyre
367,014 A 7/1887 Wandrey et al.
537,998 A 4/1895 Spring et al.
541,025 A 6/1895 Gray
685,719 A 10/1901 Harris
700,888 A 5/1902 Battistini
744,908 A 11/1903 Dallas
846,338 A 3/1907 McNamara
894,110 A 7/1908 Bloss
896,875 A 8/1908 Williams
896,876 A 8/1908 Williams
911,960 A 2/1909 Ellis
1,112,547 A 10/1914 Morin
1,183,445 A 5/1916 Foxwell
1,984,164 A 12/1934 Stock
2,059,388 A 11/1936 Nelms
2,077,298 A 4/1937 Zelger
2,089,599 A 8/1937 Crecelius
2,511,288 A 6/1950 Morrell et al.
3,194,629 A 7/1965 Dreibelbis et al.
3,599,610 A 8/1971 Spector
3,662,523 A 5/1972 Revoir et al.
3,725,530 A 4/1973 Kawase et al.
3,754,074 A 8/1973 Grantham
3,764,496 A 10/1973 Hultman et al.
3,786,619 A 1/1974 Melkersson et al.
3,803,803 A 4/1974 Raduly et al.
3,823,676 A 7/1974 Cook et al.
3,826,618 A 7/1974 Capuano
3,838,190 A 9/1974 Birke et al.
3,849,267 A 11/1974 Hilgen et al.
3,849,537 A 11/1974 Allgulin
3,851,042 A 11/1974 Minnick
3,876,393 A 4/1975 Kasai et al.
3,956,458 A 5/1976 Anderson
3,961,020 A 6/1976 Seki
3,974,254 A 8/1976 de la Cuadra Herra et al.
4,075,282 A 2/1978 Storp et al.
4,094,777 A 6/1978 Sugier et al.
4,101,631 A 7/1978 Ambrosini et al.
4,115,518 A 9/1978 Delmon et al.
4,140,654 A 2/1979 Yoshioka et al.
4,148,613 A 4/1979 Myers
4,174,373 A 11/1979 Yoshida et al.
4,196,173 A 4/1980 Dejong et al.
4,212,853 A 7/1980 Fukui
4,233,274 A 11/1980 Allgulin
4,262,610 A 4/1981 Hein et al.
4,273,747 A 6/1981 Rasmussen
4,342,192 A 8/1982 Heyn et al.
4,387,653 A 6/1983 Voss
4,427,630 A 1/1984 Aibe et al.
4,440,100 A 4/1984 Michelfelder et al.
4,474,896 A 10/1984 Chao
4,500,327 A 2/1985 Nishino et al.
4,503,785 A 3/1985 Scocca
4,519,995 A 5/1985 Schrofelbauer et al.
4,555,392 A 11/1985 Steinberg
4,578,256 A 3/1986 Nishino et al.
4,626,418 A 12/1986 College et al.
4,678,481 A 7/1987 Diep
4,693,731 A 9/1987 Tarakad et al.
4,708,853 A 11/1987 Matviya et al.
4,729,882 A 3/1988 Ide et al.
4,741,278 A 5/1988 Franke et al.
4,751,065 A 6/1988 Bowers
4,758,371 A 7/1988 Bhatia
4,758,418 A 7/1988 Yoo et al.
4,772,455 A 9/1988 Izumi et al.
4,779,207 A 10/1988 Woracek et al.
4,786,483 A 11/1988 Audeh
4,803,059 A 2/1989 Sullivan et al.
4,804,521 A 2/1989 Rochelle et al.
4,807,542 A 2/1989 Dykema
4,814,152 A 3/1989 Yan
4,820,318 A 4/1989 Chang et al.
4,824,441 A 4/1989 Kindig
4,830,829 A 5/1989 Craig, Jr.
4,873,930 A 10/1989 Egense et al.
4,876,025 A 10/1989 Roydhouse
4,886,519 A 12/1989 Hayes et al.
4,889,698 A 12/1989 Moller et al.
4,892,567 A 1/1990 Yan
4,915,818 A 4/1990 Yan
4,917,862 A 4/1990 Kraw et al.
4,936,047 A 6/1990 Feldmann et al.
4,956,162 A 9/1990 Smith et al.
4,964,889 A 10/1990 Chao
5,013,358 A 5/1991 Ball et al.
5,024,171 A 6/1991 Krigmont et al.
5,047,219 A 9/1991 Epperly et al.
5,049,163 A 9/1991 Huang et al.
5,058,514 A 10/1991 Mozes et al.
5,116,793 A 5/1992 Chao et al.
5,120,516 A 6/1992 Ham et al.
5,122,353 A 6/1992 Valentine
5,124,135 A 6/1992 Girrbach et al.
5,126,300 A 6/1992 Pinnavaia et al.
5,202,301 A 4/1993 McNamara
5,238,488 A 8/1993 Wilhelm
5,238,629 A 8/1993 Davidson
5,245,120 A 9/1993 Srinivasachar et al.
5,277,135 A 1/1994 Dubin
5,288,306 A 2/1994 Aibe et al.
5,300,137 A 4/1994 Weyand et al.
5,320,817 A 6/1994 Hardwick et al.
5,328,673 A 7/1994 Kaczur et al.
5,336,835 A 8/1994 McNamara
5,346,674 A 9/1994 Weinwurm et al.
5,350,728 A 9/1994 Cameron et al.
5,352,647 A 10/1994 Suchenwirth
5,354,363 A 10/1994 Brown, Jr. et al.
5,356,611 A 10/1994 Herkelmann et al.
5,368,617 A 11/1994 Kindig
5,403,548 A 4/1995 Aibe et al.
5,409,522 A 4/1995 Durham et al.
5,419,834 A 5/1995 Straten
5,435,843 A 7/1995 Roy et al.
5,435,980 A 7/1995 Felsvang et al.
5,447,703 A 9/1995 Baer et al.
5,460,643 A 10/1995 Hasenpusch et al.
5,480,619 A 1/1996 Johnson et al.
5,499,587 A 3/1996 Rodriquez et al.
5,502,021 A 3/1996 Schuster

(56) References Cited

U.S. PATENT DOCUMENTS 5,505,746 A 4/1996 Chriswell et al.
5,505,766 A 4/1996 Chang
5,520,898 A 5/1996 Pinnavaia et al.
5,536,482 A 7/1996 Diep et al.
5,569,436 A 10/1996 Lerner
5,571,490 A 11/1996 Bronicki et al.
5,575,982 A 11/1996 Reiss et al.
5,587,003 A 12/1996 Bulow et al.
5,607,496 A 3/1997 Brooks
5,607,654 A 3/1997 Lerner
5,618,508 A 4/1997 Suchenwirth et al.
5,635,150 A 6/1997 Coughlin
5,648,508 A 7/1997 Yaghi
5,670,122 A 9/1997 Zamansky et al.
5,672,323 A 9/1997 Bhat et al.
5,674,459 A 10/1997 Gohara et al.
5,679,957 A 10/1997 Durham et al.
5,695,726 A 12/1997 Lerner
5,733,360 A 3/1998 Feldman et al.
5,733,516 A 3/1998 DeBerry
5,738,834 A 4/1998 DeBerry
5,744,109 A 4/1998 Sitges Menendez et al.
5,785,932 A 7/1998 Helfritch
5,787,823 A 8/1998 Knowles
5,809,910 A 9/1998 Svendssen
5,809,911 A 9/1998 Feizollahi
5,810,910 A 9/1998 Ludwig et al.
5,827,352 A 10/1998 Altman et al.
5,871,703 A 2/1999 Alix et al.
5,875,722 A 3/1999 Gosselin et al.
5,891,324 A 4/1999 Ohtsuka
5,897,688 A 4/1999 Voogt et al.
5,900,042 A 5/1999 Mendelsohn et al.
5,910,292 A 6/1999 Alvarez, Jr. et al.
5,989,506 A 11/1999 Markovs
6,001,152 A 12/1999 Sinha
6,013,593 A 1/2000 Lee et al.
6,024,931 A 2/2000 Hanulik
6,027,551 A 2/2000 Hwang et al.
6,080,281 A 6/2000 Attia
6,083,403 A 7/2000 Tang
6,117,403 A 9/2000 Alix et al.
6,132,692 A 10/2000 Alix et al.
6,136,072 A 10/2000 Sjostrom et al.
6,136,281 A 10/2000 Meischen et al.
6,136,749 A 10/2000 Gadkaree
6,202,574 B1 3/2001 Liljedahl et al.
6,214,304 B1 4/2001 Rosenthal et al.
6,231,643 B1 5/2001 Pasic et al.
6,248,217 B1 6/2001 Biswas et al.
6,250,235 B1 6/2001 Oehr et al.
6,258,334 B1 7/2001 Gadkaree et al.
6,284,199 B1 9/2001 Downs et al.
6,284,208 B1 9/2001 Thomassen
6,294,139 B1 9/2001 Vicard et al.
6,328,939 B1 12/2001 Amrhein
6,348,178 B1 2/2002 Sudduth et al.
6,368,511 B1 4/2002 Weissenberg et al.
6,372,187 B1 4/2002 Madden et al.
6,375,909 B1 4/2002 Dangtran et al.
6,383,981 B1 5/2002 Blakenship et al.
6,447,740 B1 9/2002 Caldwell et al.
6,475,451 B1 11/2002 Leppin et al.
6,521,021 B1 2/2003 Pennline et al.
6,524,371 B2 2/2003 El-Shoubary et al.
6,528,030 B2 3/2003 Madden et al.
6,533,842 B1 3/2003 Maes et al.
6,558,454 B1 5/2003 Chang et al.
6,576,585 B2 6/2003 Fischer et al.
6,582,497 B1 6/2003 Maes et al.
6,589,318 B2 7/2003 El-Shoubary et al.
6,610,263 B2 8/2003 Pahlman et al.
6,613,110 B2 9/2003 Sanyal
6,638,347 B2 10/2003 El-Shoubary et al.
6,638,485 B1 10/2003 Iida et al.
6,649,082 B2 11/2003 Hayasaka et al.
6,682,709 B2 1/2004 Sudduth et al.
6,694,900 B2 2/2004 Lissianski et al.
6,702,569 B2 3/2004 Kobayashi et al.
6,719,828 B1 4/2004 Lovell et al.
6,726,888 B2 4/2004 Lanier et al.
6,729,248 B2 5/2004 Johnson et al.
6,732,055 B2 5/2004 Bagepalli et al.
6,737,031 B2 5/2004 Beal et al.
6,773,471 B2 8/2004 Johnson et al.
6,787,742 B2 9/2004 Kansa et al.
6,790,420 B2 9/2004 Breen et al.
6,808,692 B2 10/2004 Oehr
6,818,043 B1 11/2004 Chang et al.
6,827,837 B2 12/2004 Minter
6,841,513 B2 1/2005 El-Shoubary et al.
6,848,374 B2 2/2005 Srinivasachar et al.
6,855,859 B2 2/2005 Nolan et al.
6,860,911 B2 3/2005 Hundley
6,878,358 B2 4/2005 Vosteen et al.
6,883,444 B2 4/2005 Logan et al.
6,916,762 B2 7/2005 Shibuya et al.
6,942,840 B1 9/2005 Broderick
6,945,925 B2 9/2005 Pooler et al.
6,953,494 B2 10/2005 Nelson, Jr.
6,960,329 B2 11/2005 Sellakumar
6,962,617 B2 11/2005 Simpson
6,969,494 B2 11/2005 Herbst
6,972,120 B2 12/2005 Holste et al.
6,974,564 B2 12/2005 Biermann
6,975,975 B2 12/2005 Fasca
7,008,603 B2 3/2006 Brooks et al.
7,013,817 B2 3/2006 Stowe, Jr. et al.
7,017,330 B2 3/2006 Bellows
7,111,591 B2 9/2006 Schwab et al.
7,118,720 B1 10/2006 Mendelsohn et al.
7,141,091 B2 11/2006 Chang
7,153,481 B2 12/2006 Bengtsson et al.
7,156,959 B2 1/2007 Herbst
7,198,769 B2 4/2007 Cichanowicz
7,211,707 B2 5/2007 Axtell et al.
7,217,401 B2 5/2007 Ramme et al.
7,250,387 B2 7/2007 Durante et al.
7,270,063 B2 9/2007 Aradi et al.
7,332,002 B2 2/2008 Johnson et al.
7,361,209 B1 4/2008 Durham et al.
7,381,380 B2 6/2008 Herbst
7,381,387 B2 6/2008 Lissianski et al.
7,381,388 B2 6/2008 Cooper et al.
7,384,615 B2 6/2008 Boardman et al.
7,413,719 B2 8/2008 Digdon
7,416,137 B2 8/2008 Hagen et al.
7,430,969 B2 10/2008 Stowe, Jr. et al.
7,435,286 B2 10/2008 Olson et al.
7,442,239 B2 10/2008 Armstrong et al.
7,452,392 B2 11/2008 Nick et al.
7,468,170 B2 12/2008 Comrie
7,473,303 B1 1/2009 Higgins et al.
7,479,215 B2 1/2009 Carson et al.
7,479,263 B2 1/2009 Chang et al.
7,494,632 B1 2/2009 Klunder
7,497,076 B2 3/2009 Funk et al.
7,507,083 B2 3/2009 Comrie
7,514,052 B2 4/2009 Lissianski et al.
7,514,053 B2 4/2009 Johnson et al.
7,517,511 B2 4/2009 Schofield
7,521,032 B2 4/2009 Honjo et al.
7,524,473 B2 4/2009 Lindau et al.
7,544,338 B2 6/2009 Honjo et al.
7,544,339 B2 6/2009 Lissianski et al.
7,563,311 B2 7/2009 Graham
7,611,564 B2 11/2009 McChesney et al.
7,615,101 B2 11/2009 Holmes et al.
7,622,092 B2 11/2009 Honjo et al.
7,651,541 B2 1/2010 Hundley et al.
7,674,442 B2 3/2010 Comrie
7,712,306 B2 5/2010 White et al.
7,713,503 B2 5/2010 Maly et al.
7,722,843 B1 5/2010 Srinivasachar

(56) References Cited

U.S. PATENT DOCUMENTS 7,727,307 B2 6/2010 Winkler
7,758,827 B2 7/2010 Comrie
7,767,174 B2 8/2010 Liu et al.
7,776,301 B2 8/2010 Comrie
7,780,765 B2 8/2010 Srinivasachar et al.
7,862,630 B2 1/2011 Hundley et al.
7,906,090 B2 3/2011 Ukai et al.
7,938,571 B1 5/2011 Irvine
7,955,577 B2 6/2011 Comrie
7,988,939 B2 8/2011 Comrie
8,007,749 B2 8/2011 Chang et al.
8,017,550 B2 9/2011 Chao et al.
8,069,797 B2 12/2011 Srinivasachar et al.
8,071,060 B2 12/2011 Ukai et al.
8,080,088 B1 12/2011 Srinivasachar
8,101,144 B2 1/2012 Sasson et al.
8,124,036 B1 2/2012 Baldrey et al.
8,168,149 B2 5/2012 Gal et al.
8,216,535 B2 7/2012 Pollack et al.
8,226,913 B2 7/2012 Comrie
8,293,196 B1 10/2012 Baldrey et al.
8,303,919 B2 11/2012 Gadgil et al.
8,312,822 B2 11/2012 Holmes et al.
8,313,323 B2 11/2012 Comrie
8,372,362 B2 2/2013 Durham et al.
8,420,034 B2 4/2013 Nochi et al.
8,481,455 B1 7/2013 Jain et al.
8,496,894 B2 7/2013 Durham et al.
8,524,179 B2 9/2013 Durham et al.
8,574,324 B2 11/2013 Comrie
8,652,235 B2 2/2014 Olson et al.
8,663,594 B2 3/2014 Kawamura et al.
8,807,056 B2 8/2014 Holmes et al.
8,845,986 B2 9/2014 Senior et al.
8,865,099 B1 10/2014 Gray et al.
8,883,099 B2 11/2014 Sjostrom et al.
8,919,266 B2 12/2014 Johnson et al.
8,951,487 B2 2/2015 Durham et al.
8,980,207 B1 3/2015 Gray et al.
9,221,013 B2 12/2015 Sjostrom et al.
9,238,782 B2 1/2016 Senior et al.
9,308,493 B2 4/2016 Filippelli et al.
9,352,275 B2 5/2016 Durham et al.
9,409,123 B2 8/2016 Sjostrom et al.
9,416,967 B2 8/2016 Comrie
9,555,369 B2 1/2017 Moore et al.
9,657,942 B2 5/2017 Durham et al.
9,822,973 B2 11/2017 Comrie
9,827,551 B2 11/2017 Hardwick et al.
9,850,442 B2 12/2017 Senior et al.
9,884,286 B2 2/2018 Sjostrom
9,889,405 B2 2/2018 Sjostrom et al.
9,889,451 B2 2/2018 Filippelli et al.
9,957,454 B2 5/2018 Morris et al.
10,124,293 B2 11/2018 Durham et al.
10,159,931 B2 12/2018 Sjostrom et al.
10,427,096 B2 10/2019 Sjostrom et al.
10,465,137 B2 11/2019 Senior et al.
10,589,292 B2 3/2020 Filippelo et al.
10,730,015 B2 8/2020 Durham et al.
10,731,095 B2 8/2020 Senior et al.
10,758,863 B2 9/2020 Sjostrom et al.
10,767,130 B2 9/2020 Morris et al.
2002/0114749 A1 8/2002 Cole
2002/0134242 A1 9/2002 Yang et al.
2002/0150516 A1 10/2002 Pahlman
2003/0065236 A1 4/2003 Vosteen et al.
2003/0099585 A1 5/2003 Allgulin
2003/0104937 A1 6/2003 Sinha
2003/0164309 A1 9/2003 Nakamura et al.
2003/0166988 A1 9/2003 Hazen et al.
2003/0192234 A1 10/2003 Logan et al.
2003/0196578 A1 10/2003 Logan et al.
2003/0206843 A1 11/2003 Nelson, Jr.
2003/0206846 A1 11/2003 Jangbarwala
2003/0226312 A1 12/2003 Roos et al.
2004/0013589 A1 1/2004 Vosteen et al.
2004/0040438 A1 3/2004 Baldrey et al.
2004/0063210 A1 4/2004 Steichen et al.
2004/0076570 A1 4/2004 Jia
2004/0109800 A1 6/2004 Pahlman
2004/0129607 A1 7/2004 Slater et al.
2005/0019240 A1 1/2005 Lu et al.
2005/0026008 A1 2/2005 Heaton et al.
2005/0074380 A1 4/2005 Hammel et al.
2005/0106516 A1 5/2005 Payne et al.
2005/0169824 A1 8/2005 Downs et al.
2005/0227146 A1 10/2005 Ghantous et al.
2005/0260112 A1 11/2005 Hensman
2006/0027488 A1 2/2006 Gauthier
2006/0029531 A1 2/2006 Breen et al.
2006/0051270 A1 3/2006 Brunette
2006/0090678 A1 5/2006 Kriech
2006/0112823 A1 6/2006 Avin
2006/0124444 A1 6/2006 Nakamura et al.
2006/0185226 A1 8/2006 McDonald et al.
2006/0191835 A1 8/2006 Petrik et al.
2006/0205592 A1 9/2006 Chao et al.
2007/0140940 A1 6/2007 Varma et al.
2007/0156288 A1 7/2007 Wroblewski et al.
2007/0167309 A1 7/2007 Olson
2007/0168213 A1 7/2007 Comrie
2007/0179056 A1 8/2007 Baek et al.
2007/0180990 A1 8/2007 Downs et al.
2007/0184394 A1 8/2007 Comrie
2007/0234902 A1 10/2007 Fair et al.
2007/0281253 A1 12/2007 Toqan
2007/0295347 A1 12/2007 Paine et al.
2008/0017337 A1 1/2008 Duggirala
2008/0090951 A1 4/2008 Mao et al.
2008/0107579 A1 5/2008 Downs et al.
2008/0115704 A1 5/2008 Berry et al.
2008/0134888 A1 6/2008 Chao et al.
2008/0182747 A1 7/2008 Sinha
2008/0207443 A1 8/2008 Gadkaree et al.
2008/0220387 A1 9/2008 Payne et al.
2008/0292512 A1 11/2008 Kang
2009/0007785 A1 1/2009 Kimura et al.
2009/0031708 A1 2/2009 Schmidt
2009/0031929 A1 2/2009 Boardman et al.
2009/0062119 A1 3/2009 Olson et al.
2009/0081092 A1 3/2009 Yang et al.
2009/0104097 A1 4/2009 Dunson, Jr.
2009/0136401 A1 5/2009 Yang et al.
2009/0148372 A1 6/2009 Keiser
2009/0235848 A1 9/2009 Eiteneer et al.
2009/0287013 A1 11/2009 Morrison
2009/0320678 A1 12/2009 Chang et al.
2010/0025302 A1 2/2010 Sato et al.
2010/0047146 A1 2/2010 Olson et al.
2010/0189617 A1 7/2010 Hundley et al.
2010/0189618 A1 7/2010 White et al.
2011/0030592 A1 2/2011 Baldrey et al.
2011/0076210 A1 3/2011 Pollack et al.
2011/0168018 A1 7/2011 Mohamadalizadeh et al.
2011/0250111 A1 10/2011 Pollack et al.
2011/0262873 A1 10/2011 Nalepa et al.
2011/0281222 A1 11/2011 Comrie
2012/0124893 A1* 5/2012 McRobbie ..... C10L 10/00 44/280
2012/0183458 A1 7/2012 Olson et al.
2012/0216729 A1 8/2012 Baldrey et al.
2012/0272877 A1 11/2012 Comrie
2012/0285352 A1* 11/2012 Senior ..... C10L 9/10 110/342
2012/0311924 A1 12/2012 Richardson et al.
2013/0074745 A1 3/2013 Comrie
2013/0078169 A1 3/2013 LaFlesh et al.
2013/0139738 A1 6/2013 Grubbström et al.
2013/0149206 A1 6/2013 Ukai et al.
2013/0280156 A1 10/2013 Olson et al.
2013/0312646 A1 11/2013 Comrie
2014/0030178 A1 1/2014 Martin
2014/0140908 A1 5/2014 Nalepa et al.

(56) References Cited

U.S. PATENT DOCUMENTS

| | | | |
|---|---|---|---|
| 2014/0141380 | A1 | 5/2014 | Comrie |
| 2014/0202069 | A1 | 7/2014 | Aradi et al. |
| 2014/0213429 | A1 | 7/2014 | Nochi et al. |
| 2014/0245936 | A1 | 9/2014 | Pollack et al. |
| 2014/0271418 | A1 | 9/2014 | Keiser et al. |
| 2014/0299028 | A1 | 10/2014 | Kotch et al. |
| 2014/0308191 | A1 | 10/2014 | Mazyck et al. |
| 2014/0341793 | A1 | 11/2014 | Holmes et al. |
| 2015/0086457 | A1 | 3/2015 | Kagawa et al. |
| 2015/0096480 | A1 | 4/2015 | Comrie |
| 2016/0025337 | A1 | 1/2016 | Comrie |
| 2016/0166982 | A1 | 6/2016 | Holmes et al. |
| 2016/0339385 | A1 | 11/2016 | Mimna et al. |
| 2017/0050147 | A1 | 2/2017 | Denny et al. |
| 2017/0292700 | A1 | 10/2017 | Comrie |
| 2018/0224121 | A1 | 8/2018 | Comrie |
| 2019/0321778 | A1 | 10/2019 | Sjostrom et al. |
| 2020/0230550 | A1 | 7/2020 | Sjostrom et al. |

FOREIGN PATENT DOCUMENTS

| | | |
|---|---|---|
| CA | 2026056 | 3/1992 |
| CA | 2150529 | 12/1995 |
| CA | 2400898 | 8/2001 |
| CA | 2418578 | 8/2003 |
| CA | 2435474 | 1/2004 |
| CA | 2584327 | 4/2006 |
| CA | 2641311 | 8/2007 |
| CA | 2737281 | 4/2010 |
| CN | 1048173 | 1/1991 |
| CN | 1177628 | 4/1998 |
| CN | 1354230 | 6/2002 |
| CN | 1382657 | 12/2002 |
| CN | 1421515 | 6/2003 |
| CN | 1488423 | 4/2004 |
| CN | 101048218 | 10/2007 |
| CN | 101053820 | 10/2007 |
| CN | 101175550 | 5/2008 |
| CN | 101347722 | 1/2009 |
| CN | 101489647 | 7/2009 |
| CN | 101816922 | 9/2010 |
| CN | 101932376 | 12/2010 |
| CN | 102413899 | 4/2012 |
| CN | 105381680 | 3/2016 |
| DE | 2630202 | 2/1977 |
| DE | 3426059 | 1/1986 |
| DE | 3615759 | 11/1987 |
| DE | 3628963 | 3/1988 |
| DE | 3711503 | 10/1988 |
| DE | 3918292 | 4/1990 |
| DE | 4218672 | 8/1993 |
| DE | 4308388 | 10/1993 |
| DE | 4339777 | 5/1995 |
| DE | 4422661 | 1/1996 |
| DE | 19520127 | 12/1996 |
| DE | 19745191 | 4/1999 |
| DE | 19850054 | 5/2000 |
| DE | 10233173 | 7/2002 |
| EP | 0208036 | 1/1987 |
| EP | 0208490 | 1/1987 |
| EP | 0220075 | 4/1987 |
| EP | 0254697 | 1/1988 |
| EP | 0274132 | 7/1988 |
| EP | 0433677 | 6/1991 |
| EP | 0435848 | 7/1991 |
| EP | 0628341 | 12/1994 |
| EP | 0666098 | 8/1995 |
| EP | 0709128 | 5/1996 |
| EP | 0794240 | 9/1997 |
| EP | 0908217 | 4/1999 |
| EP | 1040865 | 10/2000 |
| EP | 1213046 | 10/2001 |
| EP | 1199354 | 4/2002 |
| EP | 1271053 | 1/2003 |
| EP | 1386655 | 2/2004 |
| EP | 1570894 | 9/2005 |
| EP | 1903092 | 3/2008 |
| EP | 2452740 | 5/2012 |
| ES | 2443580 | 2/2014 |
| FR | 1394547 | 4/1965 |
| GB | 1121845 | 7/1968 |
| GB | 2122916 | 1/1984 |
| GB | 2441885 | 3/2008 |
| JP | 49-53591 | 5/1974 |
| JP | 49-53593 | 5/1974 |
| JP | 49-53594 | 5/1974 |
| JP | 59-10343 | 1/1984 |
| JP | 59-76537 | 5/1984 |
| JP | 59-160534 | 9/1984 |
| JP | 63-100918 | 5/1988 |
| JP | H02-303519 | 12/1990 |
| JP | H10-5537 | 1/1998 |
| JP | 10-109016 | 4/1998 |
| JP | 2000-197811 | 7/2000 |
| JP | 2000-205525 | 7/2000 |
| JP | 2000-325747 | 11/2000 |
| JP | 2001-347131 | 12/2001 |
| JP | 2003-065522 | 3/2003 |
| JP | 2004-066229 | 3/2004 |
| JP | 2005-230810 | 9/2005 |
| JP | 5064389 | 10/2012 |
| KR | 1020027006149 | 5/2002 |
| KR | 2004-0010276 | 1/2004 |
| KR | 100440845 | 7/2004 |
| RU | 2007-138432 | 4/2009 |
| RU | 2515988 | 5/2014 |
| RU | 2535684 | 12/2014 |
| WO | WO 96/14137 | 5/1996 |
| WO | WO 96/30318 | 10/1996 |
| WO | WO 97/44500 | 11/1997 |
| WO | WO 98/15357 | 4/1998 |
| WO | WO 99/58228 | 11/1999 |
| WO | WO 2001/38787 | 5/2001 |
| WO | WO 01/62368 | 8/2001 |
| WO | WO 02/28513 | 4/2002 |
| WO | WO 03/072241 | 9/2003 |
| WO | WO 2003/093518 | 11/2003 |
| WO | WO 2004/089501 | 10/2004 |
| WO | WO 2004/094024 | 11/2004 |
| WO | WO 2005/092477 | 10/2005 |
| WO | WO 2006/037213 | 4/2006 |
| WO | WO 2006/039007 | 4/2006 |
| WO | WO 2006/091635 | 8/2006 |
| WO | WO 2006/096993 | 9/2006 |
| WO | WO 2006/099611 | 9/2006 |
| WO | WO 2009/018539 | 2/2009 |
| WO | WO 2009/107731 | 9/2009 |
| WO | WO 2010/123609 | 10/2010 |
| ZA | 2003-05568 | 7/2004 |

OTHER PUBLICATIONS

U.S. Appl. No. 11/553,849, filed Oct. 27, 2006 now U.S. Pat. No. 8,124,036.

U.S. Appl. No. 13/198,381, filed Aug. 4, 2011 now U.S. Pat. No. 8,293,196.

U.S. Appl. No. 13/021,427, filed Feb. 4, 2011 now U.S. Pat. No. 8,372,362.

U.S. Appl. No. 13/281,040, filed Oct. 25, 2011 now U.S. Pat. No. 8,496,894.

U.S. Appl. No. 13/925,311, filed Jun. 24, 2013 now U.S. Pat. No. 9,352,275.

U.S. Appl. No. 14/339,233, filed Jul. 23, 2014 now U.S. Pat. No. 9,221,013.

U.S. Appl. No. 14/949,524, filed Nov. 23, 2015 now U.S. Pat. No. 9,884,286.

U.S. Appl. No. 15/850,780, filed Dec. 21, 2017 now U.S. Pat. No. 10,427,096.

U.S. Appl. No. 16/603,239, filed Jul. 3, 2019.

U.S. Appl. No. 13/471,015, filed May 14, 2012 now U.S. Pat. No. 8,845,986.

(56) References Cited

OTHER PUBLICATIONS

U.S. Appl. No. 14/484,001, filed Sep. 11, 2014 now U.S. Pat. No. 9,238,782.
U.S. Appl. No. 14/958,327, filed Dec. 3, 2015 now U.S. Pat. No. 9,850,442.
U.S. Appl. No. 15/812,993, filed Nov. 14, 2017 now U.S. Pat. No. 10,465,137.
U.S. Appl. No. 16/590,178, filed Oct. 1, 2019 now U.S. Pat. No. 10,731,095.
U.S. Appl. No. 16/909,638, filed Jun. 23, 2020.
U.S. Appl. No. 13/281,066, filed Oct. 25, 2011 now U.S. Pat. No. 8,524,179.
U.S. Appl. No. 13/920,658, filed Jun. 18, 2013 now U.S. Pat. No. 8,951,487.
U.S. Appl. No. 14/604,153, filed Jan. 23, 2015 now U.S. Pat. No. 9,657,942.
U.S. Appl. No. 15/488,244, filed Apr. 14, 2017 now U.S. Pat. No. 10,124,293.
U.S. Appl. No. 16/186,187, filed Nov. 9, 2018 now U.S. Pat. No. 10,730,015.
U.S. Appl. No. 16/910,901, filed Jun. 24, 2020.
U.S. Appl. No. 13/861,162, filed Apr. 11, 2013 now U.S. Pat. No. 8,883,099.
U.S. Appl. No. 14/512,142, filed Oct. 10, 2014 now U.S. Pat. No. 9,409,123.
U.S. Appl. No. 15/217,749, filed Jul. 22, 2016 now U.S. Pat. No. 9,889,405.
U.S. Appl. No. 15/694,536, filed Sep. 1, 2017 now U.S. Pat. No. 10,159,931.
U.S. Appl. No. 16/188,758, filed Nov. 13, 2018 now U.S. Pat. No. 10,758,863.
U.S. Appl. No. 16/834,685, filed Mar. 30, 2020.
U.S. Appl. No. 13/964,441, filed Aug. 12, 2013 now U.S. Pat. No. 9,957,454.
U.S. Appl. No. 15/941,522, filed Mar. 30, 2018 now U.S. Pat. No. 10,767,130.
U.S. Appl. No. 14/460,817, filed Aug. 15, 2014 now U.S. Pat. No. 9,308,493.
U.S. Appl. No. 15/096,056, filed Apr. 11, 2016 now U.S. Pat. No. 9,889,451.
U.S. Appl. No. 15/842,636, filed Dec. 14, 2017 now U.S. Pat. No. 10,589,292.
U.S. Appl. No. 16/909,638, filed Jun. 23, 2020, Senior.
U.S. Appl. No. 16/910,901, filed Jun. 24, 2020, Durham.
"Continuous Emissions Monitors (CEMs): Field Studies of Dioxin/Furan CEMs," printed on Apr. 22, 2012, available at www.ejnet.org/toxics/cems/dioxin.html, 5 pages.
"DOE Announces Further Field Testing of Advanced Mercury Control Technologies, Six Projects Selected in Round 2 to Address Future Power Plant Mercury Reduction Initiatives," TECHNews From the National Energy Technology Laboratory, Nov. 5, 2004, available at http://www.netl.doe.gov/publications/TechNews/tn_mercury-control.html, printed on Jun. 3, 2009, pp. 1-2.
"Enhanced Mercury Control: KNX™ Coal Additive Technology," Alstom Power Inc., printed Aug. 3, 2006, 1 page.
"Evaluation of Sorbent Injection for Mercury Control at Great River Energy Coal Creek Station," ADA Environmental Solutions, Nov. 16-20, 2003 Final Report, Electric Power Research Institute, issued Mar. 3, 2004, 32 pages.
"Exclusive license agreement for an innovative mercury oxidation technology," Alstom Power Inc., printed Nov. 2, 2006, 1 page.
"Full-Scale Testing of Enhanced Mercury Control Technologies for Wet FGD Systems: Final Report for the Period Oct. 1, 2000 to Jun. 30, 2002," submitted by McDermott Technology, Inc., May 7, 2003, 151 pages.
"Gas Phase Filtration," Vaihtoilma White Air Oy, date unknown, 3 pages.
"Impregnated Activated Carbon," Products and Technologies Website, as early as 1999, available at http://www.calgoncarbon.com/product/impregnated.html, printed on Dec. 18, 1999, p. 1.
"Integrating Flue Gas Conditioning with More Effective Mercury Control," Power Engineering, Jun. 17, 2014, retrieved from www.power-eng.com/articles/print/volume-118/issue-6/features/integrating-flue-gas-conditioning-with-more-effective-mercury-control, 9 pages.
"Kaolinite Sorbent for the Removal of Heavy Metals from Incinerated Lubricating Oils," EPA Grant No. R828598C027, 1996, retrieved from https://cfpub.epa.gov/ncer_abstracts/index.cfm/fuseaction/display.highlight/abstract/1166, 7 pages.
"Mercury Emission Control Utilizing the Chem-Mod Process," Chem-Mod, EUEC 2011, 34 pages (submitted in 2 parts).
"Mercury Study Report to Congress—vol. VIII: An Evaluation of Mercury Control Technologies and Costs," U.S. EPA, Office of Air Quality Planning & Standards and Office of Research and Development, Dec. 1997, 207 pages.
"Mercury," Pollution Prevention and Abatement Handbook 1998, World Bank Group, effective Jul. 1998, pp. 219-222.
"Nusorb® Mersorb® Family of Adsorbents for Mercury Control," Nucon International Inc., date unknown, 3 pages.
"Protecting Human Health. Mercury Poisoning," US EPA Website, as early as Oct. 8, 1999, availabie at http://www.epa.gov/region02/health/mercury/, printed on Feb. 5, 2002, pp. 1-4.
"Sample Collection Media: Sorbent Sample Tubes," SKC 1997 Comprehensive Catalog & Air Sampling Guide: The Essential Reference for Air Sampling, pp. 23-24.
"Sodium Hypochlorite," Wikipedia, The Free Encyclopedia, http://en.wikipedia.org/wiki/Sodium_hypochlorite (page last modified on Jul. 7, 2011 at 18:12), 7 pages.
"Texas Genco, EPRI, and URS Corporation Test Innovative Mercury Control Method at Limestone Station—Technology Aims to Capture More Mercury from Power Plant Exhaust," News Release, Jan. 11, 2005, available at http://amptest.epri.com/corporate/discover_epri/news/2005/011105_mercury.html, printed on Apr. 24, 2009, pp. 1-2.
"The Fire Below: Spontaneous combustion in Coal," U.S. Department of Energy, Environmental Safety & Health Bulletin, DOE/EH-0320, May 1993, Issue No. 93-4, 9 pages.
"Incineration," Focus on your success, Bayer Industry Services, retrieved from www.entsorgung.bayer.com/index.cfmPAGE-ID=301, Jun. 2, 2005, 2 pages.
Anders et al., "Selenium in Coal-Fired Steam Plant Emissions," Environmental Science & Technology, 1975, vol. 9, No. 9, pp. 856-858.
Ariya et al., "Reactions of Gaseous Mercury with Atomic and Molecular Halogens: Kinetics, Product Studies, and Atmospheric Implications," J. Phys. Chem. A, 2002, vol. 106(32), pp. 7310-7320.
Bansal et al., Active Carbon, Marcel Dekker, Inc., New York, 1989, pp. 1-3, 24-29, 391-394, 457.
Beer, J. M., "Combustion technology developments in power generation in response to environmental challenges," Progress in Energy and Combustion Science, 2000, vol. 26, pp. 301-327.
Biswas et al., "Control of Toxic Metal Emissions from Combustors Using Sorbents: A Review," J. Air & Waste Manage. Assoc., Feb. 1998, vol. 48, pp. 113-127.
Bloom, "Mercury Speciation in Flue Gases: Overcoming the Analytical Difficulties," presented at EPRI Conference, Managing Hazardous Air Pollutants, State of the Arts, Washington D.C., Nov. 1991, pp. 148-160.
Blythe et al., "Investigation of Mercury Control by Wet FGD Systems," Power Plant Air Pollution Mega Symposium, Baltimore, MD, Aug. 20-23, 2012, 16 pages.
Blythe et al., "Optimization of Mercury Control on a New 800-MW PRB-Fired Power Plant," Power Plant Air Pollution Mega Symposium, Baltimore, MD, Aug. 20-23, 2012, 14 pages.
Brigatti et al., "Mercury adsorption by montmorillonite and vermiculite: a combined XRD, TG-MS, and EXAFS study," Applied Clay Science, 2005, vol. 28, pp. 1-8.
Brown et al., "Mercury Measurement and Its Control: What We Know, Have Learned, and Need to Further Investigate," J. Air & Waste Manage. Assoc, Jun. 1999, pp. 1-97.
Buschmann et al., "The KNX™ Coal Additive Technology a Simple Solution for Mercury Emissions Control," Alstom Power Environment, Dec. 2005, pp. 1-7.

(56) References Cited

OTHER PUBLICATIONS

Bustard et al., "Full-Scale Evaluation of Sorbent Injection for Mercury Control on Coal-Fired Power Plants," Air Quality III, ADA Environmental Solutions, LLC, Arlington, VA, Sep. 12, 2002, 15 pages.
Butz et al., "Options for Mercury Removal from Coal-Fired Flue Gas Streams: Pilot-Scale Research on Activated Carbon, Alternative and Regenerable Sorbents," 17th Annual Int. Pittsburgh Coal Conf. Proceedings, Pittsburgh, PA, Sep. 11-14, 2000, 25 pages.
Calgon Carbon product and bulletin webpages, printed Jul. 1, 2001, 11 pages.
Cao et al., "Impacts of Halogen Additions on Mercury Oxidation, in a Slipstream Selective Catalyst Reduction (SCR), Reactor When Burning Sub-Bituminous Coal," Environ. Sci. Technol. XXXX, xxx, 000-000, accepted Oct. 22, 2007, pp. A-F.
Carey et al., "Factors Affecting Mercury Control in Utility Flue Gas Using Activated Carbon," J. Air & Waste Manage. Assoc., Dec. 1998, vol. 48, pp. 1166-1174.
De Vito et al., "Sampling and Analysis of Mercury in Combustion Flue Gas," Presented at the Second International Conference on Managing Hazardous Air Pollutants, Washington, DC, Jul. 13-15, 1993, pp. VII39-VII-65.
Dillon et al., "Preparing for New Multi-Pollutant Regulations with Multiple Low Capital Approaches," Paper #2012-A-131-Mega, AWMA, MEGA 2012 conference, retrieved from http://www.cleancoalsolutions.com/library-resources/preparing-for-new-multi-pollutant-regulations-with-multiple-low-capital-approaches/, 20 pages.
Donnet et al., eds., Carbon Black: Science and Technology, 2nd Edition, Marcel Dekker, New York, 1993, pp. 182-187, 218-219.
Dunham et al., "Investigation of Sorbent Injection for Mercury Control in Coal-Fired Boilers," Energy & Environmental Research Center, University of North Dakota, Sep. 10, 1998, 120 pages.
Durham et al., "Full-Scale Evaluation of Mercury Control by Injecting Activated Carbon Upstream of ESPS," Air Quality IV Conference, ADA Environmental Solutions, Littleton, Colorado, Sep. 2003, 15 pages.
Edwards et al., "A Study of Gas-Phase Mercury Speciation Using Detailed Chemical Kinetics," in Journal of the Air and Waste Management Association, vol. 51, Jun. 2001, pp. 869-877.
Element Analysis of COALQUAL Data; http://energy.er.usgs.gov/temp/1301072102.htm, printed Mar. 25, 2011, 7 pages.
Elliott, "Standard Handbook of PowerPlant Engineering," excerpts from pp. 4.77-4.78, 4.109-4.110, 6.3-6.4, 6.57-6.63, McGraw Hill, Inc., 1989, 15 pages.
Fabian et al., "How Bayer incinerates wastes," Hydrocarbon Processing, Apr. 1979, pp. 183-192.
Felsvang et al., "Activated Carbon Injection in Spray Dryer/ESP/FF for Mercury and Toxics Control," 1993, pp. 1-35.
Felsvang, K. et al., "Air Toxics Control by Spray Dryer," Presented at the 1993 SO2 Control Symposium, Aug. 24-27, 1993, Boston, MA, 16 pages.
Felsvang, K. et al., "Control of Air Toxics by Dry FGDSystems," Power-Gen '92 Conference, 5th International Conference & Exhibition for the Power Generating Industries, Orlando, FL, Nov. 17-19, 1992, pp. 189-208.
Fujiwara et al., "Mercury transformation behavior on a bench-scale coal combustion furnace," Transactions on Ecology and the Environment, 2001, vol. 47, pp. 395-404.
Galbreath et al., "Mercury Transformations in Coal Combustion Flue Gas," Fuel Processing Technology, 2000, vol. 65-66, pp. 289-310.
Gale, "Mercury Adsorption and Oxidation Kinetics in Coal-Fired Flue Gas," Proceedings of the 30th International Technical Conference on Coal Utilization & Fuel Systems, 2005, pp. 979-990.
Gale, "Mercury Control with Calcium-Based Sorbents and Oxidizing Agents," Final Report of Southern Research Institute, Jul. 2005, 137 pages.
Gale, "Mercury Control with Calcium-Based Sorbents and Oxidizing Agents," Southern Research Institute, Mercury Control Technology R&D Program Review Meeting, Aug. 12-13, 2003, 25 pages.
Gale et al., "Mercury Speciation as a Function of Flue Gas Chlorine Content and Composition in a 1 MW Semi-Industrial Scale Coal-Fired Facility," In Proceedings of the Mega Symposium and Air & Waste Management Association's Specialty Conference, Washington, DC, May 19-22, 2003, Paper 28, 19 pages.
Geiger et al, "Einfluß des Schwefels auf Die Doxin-und Furanbuilding bei der Klärschlammverbrennung," VGB Kraftwerkstechnik, 1992, vol. 72, pp. 159-165.
Ghorishi et al., "Effects of Fly Ash Transition Metal Content and Flue Gas HCl/SO2 Ratio on Mercury Speciation in Waste Combustion," in Environmental Engineering Science, Nov. 2005, vol. 22, No. 2, pp. 221-231.
Ghorishi et al., "In-Flight Capture of Elemental Mercury by a Chlorine-Impregnated Activated Carbon," presented at the Air & Waste Management Association's 94h Annual Meeting & Exhibition, Orlando, FL, Jun. 2001, pp. 1-14.
Ghorishi, "Fundamentals of Mercury Speciation and Control in Coal-Fired Boilers," EAP Research and Development, EPA-600/R-98-014, Feb. 1998, pp. 1-26.
Granite et al., "Novel Sorbents for Mercury Removal from Flue Gas," National Energy Technology Laboratory, Apr. 2000, 10 pages.
Granite et al., "Sorbents for Mercury Removal from Flue Gas," U.S. Dept. of Energy, Report DOE/FETC/TR--98-01, Jan. 1998, 50 pages.
Granite et al. "The thief process for mercury removal from flue gas," Journal of environmental management 84.4 (2007):628-634.
Griffin, "A New Theory of Dioxin Formation in Municipal Solid Waste Combustion," Chemosphere, 1986, vol. 15, Nos. 9-12, pp. 1987-1990.
Griswell et al., "Progress Report on Mercury Control Retrofit at the Colstrip Power Station," Power Plant Air Pollutant Control "MEGA" Symposium, Paper #91, Aug. 30-Sep. 2, 2010, pp. 1-23.
Gullet, B.K. et al, "The Effect of Sorbent Injection Technologies on Emissions of Coal-Based, Based, Metallic Air Toxics," Proceedings of the 1993 S02 Control Symposium, vol. 2, U.S. EPA (Research Triangle Park, NC) Session 6A, Boston, MA, Aug. 24-27, 1993, 26 pages.
Gullett, B. et al., "Bench-Scale Sorption and Desorption of Mercury with Activated Carbon," Presented at the 1993 International Conference on Municipal Waste Combustion, Williamsburg, VA, Mar. 30-Apr. 2, 1993, pp. 903-917.
Gullett, B. et al., "Removal of Illinois Coal-Based Volatile Tracy Mercury," Final Technical Report, Sep. 1, 1996 through Aug. 31, 1997, 2 pages.
Guminski, "The Br—Hg (Bromine-Mercury) System," Journal of Phase Equilibria, Dec. 2000, vol. 21, No. 6, pp. 539-543.
Gutberlet et al., "The Influence of Induced Oxidation on the Operation of Wet FGD Systems," Air Quality V Conference, Arlington, VA, Sep. 19-21, 2005, 15 pages.
Haiwen, "Basic Science Series of Database of Excellent Master's Degree Theses in China," No. 07, Geochemistry of Iodine in Chinese Coal, Jul. 2008, pp. 29-32, 8 pages.
Hall et al., "Chemical Reactions of Mercury in Combustion Flue Gases," Water, Air, and Soil Pollution, 1991, vol. 56, pp. 3-14.
Hein, K.R.G. et al., Research Report entitled, "Behavior of Mercury Emission from Coal Sewage Sludge Co-combustion Taking into Account the Gaseous Species," Förderkennzeichen: PEF 398002, Apr. 2001 (English Abstract).
Henning et al., "Impregnated activated carbon for environmental protection," Gas Separation & Purification, Butterworth-Heinemann Ltd., Feb. 1993, vol. 7(4), pp. 235-240.
Ismo et al., "Formation of Aromatic Chlorinated Compounds Catalyzed by Copper and Iron," Chemosphere, 1997, vol. 34(12), pp. 2649-2662.
Jeong et al. "Nox Removal by Selective Noncatalytic Reduction with Urea Solution in a Fluidized Bed Reactor," Korean Journal of Chemical Engineering, Sep. 1999, vol. 16, No. 5, pp. 614-617.
Jozewicz et al., "Bench-Scale Scale Investigation of Mechanisms of Elemental Mercury Capture by Activated Carbon," Presented at the

(56) References Cited

OTHER PUBLICATIONS

Second International Conference on Managing Hazardous Air Pollutants, Washington, D.C., Jul. 13-15, 1993, pp. VII-85 through VII-99.
Julien et al., "The Effect of Halides on Emissions from Circulating Fluidized Bed Combustion of Fossil Fuels," Fuel, Nov. 1996, vol. 75(14), pp. 1655-1663.
Kaneko et al., "Pitting of stainless steel in bromide, chloride and bromide/chloride solutions," Corrosion Science, 2000, vol. 42(1), pp. 67-78.
Kellie et al., "The Role of Coal Properties on Chemical and Physical Transformation on Mercury in Post Combustion," presented at Air Quality IV Conference, Arlington, VA, Sep. 2003, pp. 1-14.
Kilgroe et al. "Fundamental Science and Engineering of Mercury Control in Coal-Fired Power Plants," presented at Air Quality IV Conference, Arlington, VA, Sep. 2003, 15 pages.
Kilgroe et al., "Control of Mercury Emissions from Coal-Fired Electric Utility Boilers: Interim Report including Errata dated Mar. 21, 2002," prepared by National Risk Management Research Laboratory, U.S. EPA Report EPA-600/R-01-109, Apr. 2002, 485 pages.
Kobayashi, "Japan EnviroChemicals, Ltd. Overview," Feb. 3, 2002, 3 pages.
Kramlich, "The Homogeneous Forcing of Mercury Oxidation to Provide Low-Cost Capture," Abstract, University of Washington, Department of Mechanical Engineering, Mar. 25, 2004, available at http://www.netl.doe.gov/publications/proceedings/04/UCR-HBCU/abstracts/Kramlich.pdf, pp. 1-2.
Krishnan et al., "Mercury Control by Injection of Activated Carbon and Calcium-Based Based Sorbents," Solid Waste Management: Thermal Treatment and Waste-to-Energy Technologies, U.S. EPA and AWMA, Washington, DC, Apr. 18-21, 1995, pp. 493-504.
Krishnan et al., "Mercury Control in Municipal Waste Combustors and Coal Fired Utilities," Environmental Progress, ProQuest Science Journals, Spring 1997, vol. 16, No. 1, pp. 47-53.
Krishnan et al., "Sorption of Elemental Mercury by Activated Carbons," Environmental Science and Technology, 1994, vol. 28, No. 8, pp. 1506-1512.
Lee et al., "Mercury Control Research: Effects of Fly Ash and Flue Gas Parameters on Mercury Speciation," U.S. Environmental Protection Agency National Risk Management Research Laboratory and ARCADIS, as early as 1998, Geraghy & Miller, Inc., pp. 221-238, Research Triangle Park, NC.
Lee et al., "Pilot-Scale Study of the Effect of Selective Catalytic Reduction Catalyst on Mercury Speciation in Illinois and Powder River Basin Coal Combustion Flue Gases," J. Air & Waste Manage. Assoc., May 2006, vol. 56, pp. 643-649.
Lemieux et al., "Interactions Between Bromine and Chlorine in a Pilot-Scale Hazardous Waste Incinerator," paper presented at 1996 International Incineration Conference, Savannah, GA, May 6-10, 1996, 14 pages.
Li et al., "Effect of Moisture on Adsorption of Elemental Mercury by Activated Carbons," Report No. EPA/600/A-00/104, U.S. EPA, Office of Research and Development Nation Risk Management, Research Laboratory (10-65), 2000, pp. 1-Li to 13-Li.
Li et al., "Mercury Emissions Control in Coal Combustion Systems Using Postassium Iodide: Bench-Scale and Pilot-Scale Studies," Energy & Fuels, Jan. 5, 2009, vol. 23, pp. 236-243.
Linak et al., "Toxic Metal Emissions from Incineration: Mechanisms and Control," Progress in Energy & Combustion Science, 1993, vol. 19, pp. 145-185.
Lissianski et al., "Effect of Coal Blending on Mercury Removal," presented at the Low Rank Fuels Conference, Billings, MT, Jun. 24-26, 2003, pp. 1-9.
Livengood et al., "Development of Mercury Control Techniques for Utility Boilers," for Presentation at the 88th Air & Waste Management Association Annual Meeting & Exhibit, Jun. 18-23, 1995, pp. 1-14.
Livengood et al., "Enhanced Control of Mercury Emissions Through Modified Speciation," for Presentation at the Air & Waste Management Association's 90th Meeting & Exhibition, Jun. 8-13, 1997, 14 pages.
Livengood et al., "Investigation of Modified Speciation for Enhanced Control of Mercury," Argonne National Laboratory, 1998, available at http://www.netl.doe.gov/publications/proceedings/97/97ps/ps_pdf/PS2B-9.pdf, pp. 1-15.
Luijk et al., "The Role of Bromine in the De Novo Synthesis in a Model Fly Ash System," Chemosphere, 1994, vol. 28, No. 7, pp. 1299-1309.
Matai et al., "Iodine Deficiency Disease-Local Goiter and Local Cretinism," 2nd Edition, People's Medical Publishing House, Jun. 1993, pp. 46-49, 9 pages.
Martel, K., "Brennstoff-und lastspezifische Untersuchungen zum Verhalten von Schwermetallen in Kohlenstaubfeuerungen [Fuel and load specific studies on the behavior of heavy metals in coal firing systems]," Fortschritt-Berichte VDI, Apr. 2000, pp. 1-240.
Mccoy et al., "Full-Scale Mercury Sorbent Injection Testing at DTE Energy's St. Clair Station," Paper #97, DTE Energy, as early as 2004, pp. 1-9.
Mccoy, "Urea's Unlikely Role: Emissions Reduction is new application for chemical best known as a fertilizer," Chemical and Engineering News, Jun. 6, 2011, vol. 89, No. 23, p. 32.
Meij et al., "The Fate and Behavior of Mercury in Coal-Fired Power Plants," J. Air & Waste Manage. Assoc., Aug. 2002, vol. 52, pp. 912-917.
Metals Handbook, 9th Edition, Corrosion, vol. 13, ASM International, 1987, pp. 997-998, 6 pages.
Mills Jr., "Techline: Meeting Mercury Standards," as early as Jun. 18, 2001, available at http://www.netl.doe/publications/press/2001/tl_mercuryel2.html, printed on Feb. 5, 2002, pp. 1-3.
Moberg et al., "Migration of Trace Elements During Flue Gas Desulfurization," Report No. KHM-TR-28, Jun. 1982 (abstract only).
Niksa et al., "Predicting Mercury Speciation in Coal-Derived Flue Gases," presented at the 2003 Combined Power Plant Air Pollutant Control Mega Symposium, Washington, D.C., May 2003, pp. 1-14.
Oberacker et al., "Incinerating the Pesticide Ethylene Dibromide (EDB)—A field-Scale Trail Burn Evaluation of Environmental Performance," Report EPA /600/D-88/198, Oct. 1988, pp. 1-11.
Olson et al., "An Improved Model for Flue Gas-Mercury Interactions on Activated Carbons," presented at Mega Symposium May 21, 2003, Energy & Environmental Research Center publication, Paper # 142, pp. 1-8.
Olson et al., "Oxidation Kinetics and the Model for Mercury Capture on Carbon in Flue Gas," presented at Air Quality V Conference, Sep. 21, 2005, pp. 1-7.
Oppenheimer et al., "Thermische Entsorgung von Produktionsabfällen," Entsorgungs-Praxis, 2000, vol. 6, pp. 29-33.
Pasic et al., "Membrane Electrostatic Precipitation, Center for Advanced Materials Processing," Ohio Coal Research Center Department of Mechanical Engineering, Ohio University, on or before 2001, pp. 1-Bayless to10-Bayless.
Paulik et al., "Examination of the Decomposition of CaBr2 with the Method of Simultaneous TG, DTG, DTA and EGA," Journal of Thermal Analysis, vol. 15, 1979, 4 pages.
Pavlish et al., "Status Review of Mercury Control Options for Coal-Fired Power Plants," Fuel Processing Technology, Aug. 2003, vol. 82, pp. 89-165.
Richardson et al., "Chemical Addition for Mercury Control in Flue Gas Derived from Western Coals," presented at the 2003 Combined Power Plant Air Pollutant Control Mega Symposium, Washington D.C., May 2003, Paper #63, pp. 1-16.
Rodriguez et al., "Iodine Room Temperature Sorbents for Mercury Capture in Combustion Exhausts," 2001, 14 pages.
Samaras et al., "PCDD/F Prevention by Novel Inhibitors: Addition of Inorganic S- and N-Compounds in the Fuel before Combustion," Environmental Science and Technology, 2000, vol. 34, No. 24, pp. 5092-5096.
Sarkar et al., "Adsorption of Mercury(II) by Kaolinite," Soil Science Society of America Journal, 1999, vol. 64(6), pp. 1968-1975, abstract only, 1 page.

(56) References Cited

OTHER PUBLICATIONS

Schmidt et al., "Innovative Feedback Control System for Chemical Dosing to Control Treatment Plant Odors," Proceedings of the Water Environment Federation, WEFTEC 2000: Session 11-Session 20, pp. 166-175 (Abstract), 2 pages.
Schüetze et al., "Redox potential and co-removal of mercury in wet FGD scrubbers," Air Quality VIII Conference, Crystal City, VA, Oct. 24-27, 2011, 1 page.
Schüetze et al., "Strategies for enhanced co-removal of mercury in wet FGD-scrubbers—process control and additives," Flue Gas Cleaning, Helsinki, Finland, May 26, 2011, 25 pages.
Senior et al., "Gas-Phase Transformations of Mercury in Coal-Fired Power Plants," Fuel Processing Technology, vol. 63, 2000, pp. 197-213.
Senior, "Behavior of Mercury in Air Pollution Control Devices on Coal-Fired Utility Boilers," Power Production in the 21st Century: Impacts of Fuel Quality and Operations, Engineering Foundation Conference, Snowbird, UT, Oct. 28-Nov. 2, 2001, 17 pages.
Serre et al., "Evaluation of the Impact of Chlorine on Mercury Oxidation in a Pilot-Scale Coal Combustor—the Effect of Coal Blending," U.S. Environmental Protection Agency, Sep. 2009, 21 pages.
Sjostrom et al., "Full-Scale Evaluation of Mercury Control at Great River Energy's Stanton Generating Station Using Injected Sorbents and a Spray Dryer/Baghouse," to be presented at Air Quality III Conference, Session A3b, 2002, 14 pages.
Sjostrom et al., "Full-Scale Evaluation of Mercury Control by Injecting Activated Carbon Upstream of a Spray Dryer and Fabric Filter," Presented at the 2004 combined power plant air pollutant control mega symposium, Washington, D.C., Aug. 2004, 18 pages.
Sjostrom et al., "Long-Term Carbon Injection Field Test for >90% Mercury Removal for a PRB Unit with a Spray Dryer and Fabric Filter," ADA-ES, Inc. Final Scientific/Technical Report, Apr. 2009, 82 pages.
Sjostrom, "Evaluation of Sorbent Injection for Mercury Control," ADA-ES, Inc. Topical Report for Basin Electric Power Cooperative's Laramie River Station, Jan. 16, 2006, 49 pages.
Sjostrom, "Evaluation of Sorbent Injection for Mercury Control," Topical Report for Sunflower Electric's Holcomb Station, U.S. DOE Cooperative Agreement No. DE-FC26-03NT41986, Topical Report No. 41986R07, Jun. 28, 2005, 85 pages.
Sliger et al., "Towards the Development of a Chemical Kinetic Model for the Homogeneous Oxidation of Mercury by Chlorine Species," Fuel Processing Technology, vol. 65-66, 2000, pp. 423-438.
Speight, ed., The Chemistry and Technology of Coal, CRC Press, 1994, pp. 152-155.
Starns et al., "Full-Scale Evaluation of Toxecon II™ on a Lignite-Fired Boiler" presented at US EPA/DOE/EPRI Combiner Power Plant Air Pollutant Control Symposium: The Mega Symposium, Washington, DC, Aug. 30-Sep. 2, 2004, 14 pages.
Staudt et al., "Control Technologies to Reduce Conventional and Hazardous Air Pollutants from Coal-Fired Power Plants," prepared for Northeast States for Coordinated Air Use Management (NESCAUM), Mar. 31, 2011, retrieved from www.nescaum.org/.../coal-control-technology-nescaum-report-20110330.pdf, 36 pages.
Sudhoff, "Anticipated Benefits of the Toxecon Retrofit for Mercury and Multi-Pollutant Control Technology," National Energy Technology Laboratory, Nov. 19, 2003, available at http://www.netl.doe.gov/technologies/coalpower/cctc/pubs/Benefits_TOXECON_111903.pdf, pp. 1-20.
Suzuki et al., "Instrumental neutron activation analysis for coal," Bunseki Kagaku, vol. 34, No. 5, 1985, pp. 217-223 (with English abstract).
Teller et al., "Mercury Removal from Incineration Flue Gas," Air and Water Technologies Co., for presentation at the 84th Annual Meeting & Exhibition Vancouver, British Columbia, Jun. 16-21, 1991, 10 pages.
United States Environmental Protection Agency, "Study of Hazardous Air Pollutant Emissions from Electric Utility Steam Generating Units," Report to Congress, vol. 1-2, EPA-453/R-98-004a&b, Feb. 1998, pp. 1-165.
Urabe et al., "Experimental Studies on Hg Vapor Removal Using Corona Discharge for Refuse Incinerator," Chemical Abstracts, Oct. 1997, vol. 109, 37 pages (includes translation).
Urano, S., "Studies on Bleaching Powder, VII. The Decomposition of Calcium Hypochlorite by Heat in the Presence of Calcium Chloride," Journal of the Society of Chemical Industry of Japan, vol. 31, 1928, pp. 46-52 (no translation).
Verhulst et al., "Thermodynamic Behavior of Metal Chlorides and Sulfates under the Conditions of Incineration Furnaces," Environmental Science & Technology, 1996, vol. 30, No. 1, pp. 50-56.
Vidic et al., "Uptake of Elemental Mercury Vapors by Activated Carbons," Journal of the Air & Waste Management Association, 1996, vol. 46, pp. 241-250.
Vidic et al., "Vapor-phase elemental mercury adsorption by activated carbon impregnated with chloride and cheltinq agents," Carbon, 2001, vol. 39, pp. 3-14.
Vosteen et al., Mercury Sorption and Mercury Oxidation by Chlorine and Bromine at SCR DeNOx Catalyst (Part A: Oxidation), 9th Annual EPA, DOE, EPRI, EEI Conference on Clean Air, Mercy Global Warming & Renewable Energy, Tucson, AZ, Jan. 24, 2005, 38 pages.
Vosteen et al, "Mercury-Related Chemistry in Waste Incineration and Power Generation Flue Gases," Sep. 2003, Air Quality IV, pp. 1-8.
Vosteen et al., "Bromine Enhanced Mercury Abatement from Combustion Flue Gases—Recent Industrial Applications and Laboratory Research," VGB PowerTech, International Journal for Electricity and Heat Generation, 2006, vol. 86, No. 3, pp. 70-75.
Vosteen et al., "Bromine Enhanced Mercury Abatement from Combustion Flue Gases—Recent Industrial Applications and Laboratory Research," VGB PowerTech, 2nd International Experts' Workshop on Mercury Emissions from Coal (MEC2), May 24 & 25, 2005, 8 pages.
Weber et al., "The Role of Copper(II) Chloride in the Formation of Organic Chlorine in Fly Ash," Chemosphere, 2001, vol. 42, pp. 479-582.
White et al., "Field Test of Carbon Injection for Mercury Control at Camden County Municipal Waste Combustor," EPA-600/R-93-181 (NTIS PB94-101540), Sep. 1993, pp. 1-11.
Withum et al., "Characterization of Coal Combustion By-Products for the Re-Evolution of Mercury into Ecosystems," Consol Energy Inc., Research and Development, Mar. 2005, 48 pages.
Working project report for period Oct. 1, 1999 to Sep. 30, 2001 from Institut fur Verhrenstechnik und Dampfkesselwessen (IVD), Universitat Stuttgart, dated Mar. 28, 2002, pp. 14-38.
Zevenhoven et al., "Control of Pollutants in flue gases and fuel gases," Trace Elements, Alkali Metals, 2001, 32 pages.
Zygarlicke et al., "Flue gas interactions of mercury, chlorine, and ash during coal combustion," Proceedings of the 23rd International Technical Conference on Coal Utilization and Fuel Systems, Clearwater, Florida, Mar. 9-13, 1998, pp. 517-526 (ISBN 0-03206602302).
Protest for Canadian Patent Application No. 2788820, dated Feb. 26, 2018, 6 pages.
Protest for Canadian Application No. 2788820, dated Nov. 6, 2018, 10 pages.
Notice of Protest for Canadian Application No. 2793326, dated Feb. 3, 2017, 16 pages.
Notice of Protest for Canadian Application No. 2793326, dated Jul. 7, 2017, 6 pages.
Notice of Protest for Canadian Application No. 2793326, dated Apr. 19, 2018, 17 pages.
Notice of Protest for Canadian Application No. 2793326, dated Feb. 14, 2019, 12 pages.
Official Action for U.S. Appl. No. 13/964,441, dated Jan. 23, 2015 7 pages Restriction Requirement.
Official Action for U.S. Appl. No. 13/964,441, dated Jul. 1, 2015 7 pages Restriction Requirement.
Official Action for U.S. Appl. No. 13/964,441, dated Sep. 15, 2015 8 pages.

(56) References Cited

OTHER PUBLICATIONS

Final Action for U.S. Appl. No. 13/964,441, dated Mar. 24, 2016 17 pages.
Official Action for U.S. Appl. No. 13/964,441, dated Sep. 29, 2016 16 pages.
Final Action for U.S. Appl. No. 13/964,441, dated Jun. 15, 2017 23 pages.
Notice of Allowance for U.S. Appl. No. 13/964,441, dated Mar. 22, 2018 10 pages.
Official Action for U.S. Appl. No. 15/941,522, dated Jun. 27, 2019 10 pages.
Final Action for U.S. Appl. No. 15/941,522, dated Jan. 9, 2020 14 pages.
Notice of Allowance for U.S. Appl. No. 15/941,522, dated Apr. 1, 2020 8 pages.

* cited by examiner

METHOD AND ADDITIVE FOR CONTROLLING NITROGEN OXIDE EMISSIONS

CROSS REFERENCE TO RELATED APPLICATION

The present application is a continuation application of U.S. application Ser. No. 15/941,522, filed on Mar. 30, 2018, now issued U.S. Pat. No. 10,767,130, which is a divisional application of U.S. application Ser. No. 13/964,441, filed on Aug. 12, 2013, now issued U.S. Pat. No. 9,957,454, which claims the benefits of U.S. Provisional Application Nos. 61/682,040, filed Aug. 10, 2012; 61/704,290, filed Sep. 21, 2012; 61/724,634, filed Nov. 9, 2012; and 61/792,827, filed Mar. 15, 2013, all entitled "Method to Reduce Emissions of Nitrous Oxides from Coal-Fired Boilers", each of which is incorporated herein by this reference in its entirety.

Cross reference is made to U.S. patent application Ser. No. 13/471,015, filed May 14, 2012, entitled "Process to Reduce Emissions of Nitrogen Oxides and Mercury from Coal-Fired Boilers", which claims priority to U.S. Provisional Application Nos. 61/486,217, filed May 13, 2011, and 61/543,196, filed Oct. 4, 2011, each of which is incorporated herein by this reference in its entirety.

FIELD

The disclosure relates generally to contaminant removal from gas streams and particularly to contaminant removal from combustion off-gas streams.

BACKGROUND

Coal is an abundant source of energy. While coal is abundant, the burning of coal results in significant pollutants being released into the air. In fact, the burning of coal is a leading cause of smog, acid rain, global warning, and toxins in the air (Union of Concerned Scientists). In an average year, a single, typical coal plant generates 3.7 million tons of carbon dioxide ($CO_2$), 10,000 tons of sulfur dioxide ($SO_2$), 10,200 tons of nitric oxide ($NO_x$), 720 tons of carbon monoxide (CO), 220 tons of volatile organic compounds, 225 pounds of arsenic and many other toxic metals, including mercury.

Emissions of $NO_x$ include nitric oxide (NO) and nitrogen dioxide ($NO_2$). Free radicals of nitrogen ($N_2$) and oxygen ($O_2$) combine chemically primarily to form NO at high combustion temperatures. This thermal $NO_x$ tends to form even when nitrogen is removed from the fuel. When discharged to the air, emissions of NO oxidize to form $NO_2$, which tends to accumulate excessively in many urban atmospheres. In sunlight, the $NO_2$ reacts with volatile organic compounds to form ground level ozone, eye irritants and photochemical smog.

Exhaust-after-treatment techniques can reduce significantly $NO_x$ emissions levels using various chemical or catalytic methods. Such methods are known in the art and involve selective catalytic reduction (SCR) or selective noncatalytic reduction (SNCR). Such after-treatment methods typically require some type of molecular oxygen reductant, such as ammonia, urea ($CH_4N_2O$), or other nitrogenous agent, for removal of $NO_x$ emissions.

SCR uses a solid catalyst surface to convert $NO_x$ to $N_2$. These solid catalysts are selective for $NO_x$ removal and do not reduce emissions of CO and unburned hydrocarbons. Large catalyst volumes are normally needed to maintain low levels of $NO_x$ and inhibit $NH_3$ breakthrough. The catalyst activity depends on temperature and declines with use. Normal variations in catalyst activity are accommodated only by enlarging the volume of catalyst or limiting the range of combustion operation. Catalysts may require replacement prematurely due to sintering or poisoning when exposed to high levels of temperature or exhaust contaminants. Even under normal operating conditions, the SCR method requires a uniform distribution of $NH_3$ relative to $NO_x$ in the exhaust gas. $NO_x$ emissions, however, are frequently distributed non-uniformly, so low levels of both $NO_x$ and $NH_3$ breakthrough may be achieved only by controlling the distribution of injected $NH_3$ or mixing the exhaust to a uniform $NO_x$ level.

SCR catalysts can have other catalytic effects that can undesirably alter flue gas chemistry for mercury capture. Sulfur dioxide ($SO_2$) can be catalytically oxidized to sulfur trioxide, $SO_3$, which is undesirable because it can cause problems with the operation of the boiler or the operation of air pollution control technologies, including the following: interferes with mercury capture on fly ash or with activated carbon sorbents downstream of the SCR; reacts with excess ammonia in the air preheater to form solid deposits that interfere with flue gas flow; and forms an ultrafine sulfuric acid aerosol, which is emitted out the stack.

SCR is performed typically between the boiler and air (pre) heater and, though effective in removing nitrogen oxides, represents a major retrofit for coal-fired power plants. SCR commonly requires a large catalytic surface and capital expenditure for ductwork, catalyst housing, and controls. Expensive catalysts must be periodically replaced, adding to ongoing operational costs.

Although SCR is capable of meeting regulatory $NO_x$ reduction limits, additional $NO_x$ removal prior to the SCR is desirable to reduce the amount of reagent ammonia introduced within the SCR, extend catalyst life and potentially reduce the catalyst surface area and activity required to achieve the final $NO_x$ control level. For systems without SCR installed, a $NO_x$ trim technology, such as SNCR, combined with retrofit combustion controls, such as low $NO_x$ burners and staged combustion, can be combined to achieve regulatory compliance.

SNCR is a retrofit $NO_x$ control technology in which ammonia or urea is injected post-combustion in a narrow temperature range of the flue path. SNCR can optimally remove up to 20 to 40% of $NO_x$. It is normally applied as a $NO_x$ trim method, often in combination with other $NO_x$ control methods. It can be difficult to optimize for all combustion conditions and plant load. The success of SNCR for any plant is highly dependent on the degree of mixing and distribution that is possible in a limited temperature zone. Additionally, there can be maintenance problems with SNCR systems due to injection lance pluggage and failure.

Recent tax legislation provided incentives for reducing $NO_x$ emissions by treating the combustion fuel, rather than addressing the emissions through combustion modification or SNCR or SCR type technologies downstream. To qualify for the incentive, any additive must be added before the point of combustion. The goal does not provide a straight forward solution, as the traditional reagents used to treat $NO_x$ do not survive at combustion temperatures. Therefore, a compound is required that can be mixed with the combustion fuel, move through the combustion zone, and arrive in the post-combustion zone in sufficient quantity to measurably reduce $NO_x$.

SUMMARY

These and other needs are addressed by the various aspects, embodiments, and configurations of the present disclosure. The disclosure is directed to contaminant removal by adding an additive mixture to a feed material.

The disclosure can be directed to a method for reducing $NO_x$ emissions in a pulverized coal boiler system including the steps:

(a) contacting a feed material with an additive mixture comprising an additive and a thermal stability agent to form an additive-containing feed material; and (b) combusting the additive-containing feed material to produce a contaminated gas stream including a contaminant produced by combustion of the feed material and the additive or a derivative thereof, the additive or a derivative thereof removing or causing removal of the contaminant.

The additive, in the absence of the thermal stability agent, is unstable when the feed material is combusted. In the presence of the thermal stability agent, a greater amount of the additive survives feed material combustion than in the absence of the thermal stability agent. Typically, up to about 75%, more typically up to about 60%, and even more typically up to about 50% of the additive survives feed material combustion in the presence of the thermal stability agent. Comparatively, in the absence of the thermal stability agent less than 10% of the additive commonly survives feed material combustion. For certain additives, namely urea, the additive, in the absence of the thermal stability agent, can contribute to $NO_x$ formation.

The additive can be any composition or material that is able to remove or cause removal of a targeted contaminant. For example, the additive can be a nitrogenous material targeting removal of an acid gas, such as a nitrogen oxide. Under the conditions of the contaminated gas stream, the nitrogenous material or a derivative thereof removes or causes removal of the nitrogen oxide. The nitrogenous material can include one or more of ammonia, an amine, an amide, cyanuric acid, nitride, and urea.

The additive can include multiple additives, each targeting a different contaminant. For example, the additive can include a haloamine, halamide, or other organohalide. The halogen or halide targets mercury removal while the amine or amide targets nitrogen oxide removal.

The nitrogenous material can be added to the feed material before combustion. An exemplary additive-containing feed material includes the nitrogenous material, coal, and the thermal stability agent.

The thermal stability agent can be any material that can inhibit or retard degradation or decomposition of the additive during combustion of the feed material. One type of thermal stability agent endothermically reacts with other gas stream components. Examples include a metal hydroxide, metal carbonate, metal bicarbonate, metal hydrate, and metal nitride. Another type of thermal stability agent provides a porous matrix to protect the additive from the adverse effects of feed material combustion. Exemplary thermal stability agents include zeolite, char, graphite, ash (e.g., fly ash or bottom ash) and metal oxide. Another type of thermal stability agent provides a protective coating around a portion of the additive. Exemplary thermal stability agents include a silane, siloxane, organosilane, amorphous silica, and clay.

The additive mixture can be in the form of a compound containing both the additive and thermal stability agent. Examples include a metal cyanamide and metal nitride.

The additive mixture can include other components, such as a binder to bind the additive to the thermal stability agent, a stabilizing agent, and/or dispersant. The binder can be selected to decompose during combustion of the additive-containing feed material to release the additive or a derivative thereof into the contaminated gas stream.

One additive mixture formulation is in the form of prills comprising urea and an alkaline earth metal hydroxide.

The present disclosure can provide a number of advantages depending on the particular configuration. The process of the present disclosure can broaden the operating envelope of and improve the $NO_x$ reduction performance of the SNCR while eliminating problems of reagent distribution, injection lance fouling and maintenance. It can also have a wider tolerance for process temperature variation than post-combustion SNCR since the nitrogenous reagent is introduced pre-combustion. The additive mixture can comply with $NO_x$ reduction targets set by tax legislation providing incentives for $NO_x$ reduction. The additive mixture can provide the additive with adequate protection from the heat of the combustion zone, reduce mass transfer of oxygen and combustion radicals which would break down the additive, and deliver sufficient quantities of additive to the post-flame zone to measurably reduce $NO_x$ emissions. The process can use existing boiler conditions to facilitate distribution and encourage appropriate reaction kinetics. It can use existing coal feed equipment as the motive equipment for introduction of the additives to the boiler. Only minor process-specific equipment may be required. The process can decrease the amount of pollutants produced from a fuel, while increasing the value of such fuel. Because the additive can facilitate the removal of multiple contaminants, the additive can be highly versatile and cost effective. The additive can use nitrogenous compositions readily available in certain areas, for example, the use of animal waste and the like. Accordingly, the cost for the compositions can be low and easily be absorbed by the user.

These and other advantages will be apparent from the disclosure of the aspects, embodiments, and configurations contained herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_0$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Absorption" and cognates thereof refer to the incorporation of a substance in one state into another of a different state (e.g. liquids being absorbed by a solid or gases being absorbed by a liquid). Absorption is a physical or chemical phenomenon or a process in which atoms, molecules, or ions enter some bulk phase—gas, liquid or solid material. This is a different process from adsorption, since molecules undergoing absorption are taken up by the volume, not by the surface (as in the case for adsorption).

"Adsorption" and cognates thereof refer to the adhesion of atoms, ions, biomolecules, or molecules of gas, liquid, or dissolved solids to a surface. This process creates a film of the adsorbate (the molecules or atoms being accumulated) on the surface of the adsorbent. It differs from absorption, in which a fluid permeates or is dissolved by a liquid or solid. Similar to surface tension, adsorption is generally a consequence of surface energy. The exact nature of the bonding depends on the details of the species involved, but the adsorption process is generally classified as physisorption (characteristic of weak van der Waals forces)) or chemisorption (characteristic of covalent bonding). It may also occur due to electrostatic attraction.

"Amide" refers to compounds with the functional group $R_nE(O)_xNR'_2$ (R and R' refer to H or organic groups). Most common are "organic amides" (n=1, E=C, x=1), but many other important types of amides are known including phosphor amides (n=2, E=P, x=1 and many related formulas) and sulfonamides (E=S, x=2). The term amide can refer both to classes of compounds and to the functional group ($R_nE(O)_xNR'_2$) within those compounds.

"Amines" are organic compounds and functional groups that contain a basic nitrogen atom with a lone pair. Amines are derivatives of ammonia, wherein one or more hydrogen atoms have been replaced by a substituent such as an alkyl or aryl group.

"Ash" refers to the residue remaining after complete combustion of the coal particles. Ash typically includes mineral matter (silica, alumina, iron oxide, etc.).

"Biomass" refers to biological matter from living or recently living organisms. Examples of biomass include, without limitation, wood, waste, (hydrogen) gas, seaweed, algae, and alcohol fuels. Biomass can be plant matter grown to generate electricity or heat. Biomass also includes, without limitation, plant or animal matter used for production of fibers or chemicals. Biomass further includes, without limitation, biodegradable wastes that can be burnt as fuel but generally excludes organic materials, such as fossil fuels, which have been transformed by geologic processes into substances such as coal or petroleum. Industrial biomass can be grown from numerous types of plants, including miscanthus, switchgrass, hemp, corn, poplar, willow, sorghum, sugarcane, and a variety of tree species, ranging from eucalyptus to oil palm (or palm oil).

"Circulating Fluidized Bed" or "CFB" refers to a combustion system for solid fuel (including coal or biomass). In fluidized bed combustion, solid fuels are suspended in a dense bed using upward-blowing jets of air. Combustion takes place in or immediately above the bed of suspended fuel particles. Large particles remain in the bed due to the balance between gravity and the upward convection of gas. Small particles are carried out of the bed. In a circulating fluidized bed, some particles of an intermediate size range are separated from the gases exiting the bed by means of a cyclone or other mechanical collector. These collected solids are returned to the bed. Limestone and/or sand are commonly added to the bed to provide a medium for heat and mass transfer. Limestone also reacts with $SO_2$ formed from combustion of the fuel to form $CaSO_4$.

"Coal" refers to a combustible material formed from prehistoric plant life. Coal includes, without limitation, peat, lignite, sub-bituminous coal, bituminous coal, steam coal, anthracite, and graphite. Chemically, coal is a macromolecular network comprised of groups of polynuclear aromatic rings, to which are attached subordinate rings connected by oxygen, sulfur, and aliphatic bridges.

"Halogen" refers to an electronegative element of group VIIA of the periodic table (e.g., fluorine, chlorine, bromine, iodine, astatine, listed in order of their activity with fluorine being the most active of all chemical elements).

"Halide" refers to a chemical compound of a halogen with a more electropositive element or group.

"High alkali coals" refer to coals having a total alkali (e.g., calcium) content of at least about 20 wt. % (dry basis of the ash), typically expressed as CaO, while "low alkali coals" refer to coals having a total alkali content of less than 20 wt. % and more typically less than about 15 wt. % alkali (dry basis of the ash), typically expressed as CaO.

"High iron coals" refer to coals having a total iron content of at least about 10 wt. % (dry basis of the ash), typically expressed as $Fe_2O_3$, while "low iron coals" refer to coals having a total iron content of less than about 10 wt. % (dry basis of the ash), typically expressed as $Fe_2O_3$. As will be appreciated, iron and sulfur are typically present in coal in the form of ferrous or ferric carbonates and/or sulfides, such as iron pyrite.

"High sulfur coals" refer to coals having a total sulfur content of at least about 1.5 wt. % (dry basis of the coal) while "medium sulfur coals" refer to coals having between about 1.5 and 3 wt. % (dry basis of the coal) and "low sulfur coals" refer to coals having a total sulfur content of less than about 1.5 wt. % (dry basis of the coal).

"Means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

"Micrograms per cubic meter" or "$\mu g/m^3$" refers to a means for quantifying the concentration of a substance in a gas and is the mass of the substance measured in micrograms found in a cubic meter of the gas.

"Neutron Activation Analysis" or "NAA" refers to a method for determining the elemental content of samples by irradiating the sample with neutrons, which create radioactive forms of the elements in the sample. Quantitative determination is achieved by observing the gamma rays emitted from these isotopes.

"Nitrogen oxide" and cognates thereof refer to one or more of nitric oxide (NO) and nitrogen dioxide ($NO_2$). Nitric oxide is commonly formed at higher temperatures and becomes nitrogen dioxide at lower temperatures.

The term "normalized stoichiometric ratio" or "NSR", when used in the context of $NO_x$ control, refers to the ratio of the moles of nitrogen contained in a compound that is injected into the combustion gas for the purpose of reducing $NO_x$ emissions to the moles of $NO_x$ in the combustion gas in the uncontrolled state.

"Particulate" and cognates thereof refer to fine particles, such as fly ash, unburned carbon, contaminate-carrying powdered activated carbon, soot, byproducts of contaminant removal, excess solid additives, and other fine process solids, typically entrained in a mercury-containing gas stream.

Pulverized coal ("PC") boiler refers to a coal combustion system in which fine coal, typically with a median diameter of 100 microns or less, is mixed with air and blown into a combustion chamber. Additional air is added to the combustion chamber such that there is an excess of oxygen after the combustion process has been completed.

The phrase "ppmw X" refers to the parts-per-million, based on weight, of X alone. It does not include other substances bonded to X.

"Separating" and cognates thereof refer to setting apart, keeping apart, sorting, removing from a mixture or combination, or isolating. In the context of gas mixtures, separating can be done by many techniques, including electrostatic precipitators, baghouses, scrubbers, and heat exchange surfaces.

A "sorbent" is a material that sorbs another substance; that is, the material has the capacity or tendency to take it up by sorption.

"Sorb" and cognates thereof mean to take up a liquid or a gas by sorption.

"Sorption" and cognates thereof refer to adsorption and absorption, while desorption is the reverse of adsorption.

"Urea" or "carbamide" is an organic compound with the chemical formula $CO(NH_2)_2$. The molecule has two —$NH_2$ groups joined by a carbonyl (C═O) functional group.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Overview

The current disclosure is directed to an additive thermal stability agent to inhibit thermal degradation of an additive for controlling contaminant emissions from contaminant evolving facilities, such as smelters, autoclaves, roasters, steel foundries, steel mills, cement kilns, power plants, waste incinerators, boilers, and other contaminated gas stream producing industrial facilities. Although any contaminant may be targeted by the additive introduction system, typical contaminants include acid gases (e.g., sulfur-containing compounds (such as sulfur dioxide and trioxide produced by thermal oxidation of sulfides), nitrogen oxides (such as nitrogen monoxide and dioxide), hydrogen sulfide ($H_2S$), hydrochloric acid (HCl), and hydrofluoric acid (HF)), mercury (elemental and/or oxidized forms), carbon oxides (such as carbon monoxide and dioxide), halogens and halides, and the like. Although the contaminant is typically evolved by combustion, it may be evolved by other oxidizing reactions, reducing reactions, and other thermal processes such as roasting, pyrolysis, and autoclaving, that expose contaminated materials to elevated temperatures.

Figure 1:
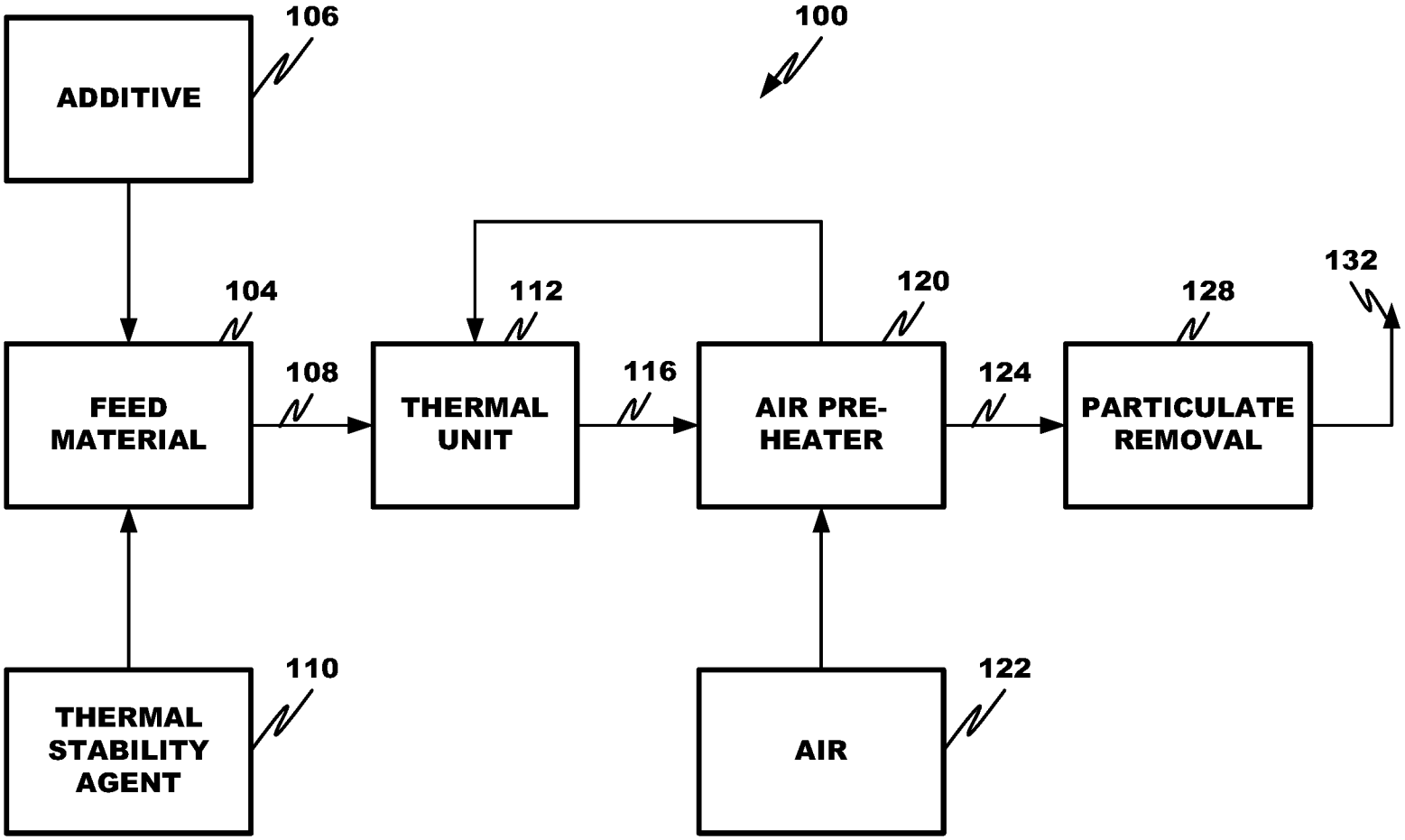
FIG. 1 is a block diagram according to an embodiment showing a common power plant configuration.

FIG. 1 depicts a contaminated gas stream treatment process 100 for an industrial facility according to an embodiment. Referring to FIG. 1, a feed material 104 is provided. In one application, the feed material 104 is combustible and can be any synthetic or natural, contaminate-containing, combustible, and carbon-containing material, including coal, petroleum coke, and biomass. The feed material 104 can be a high alkali, high iron, and/or high sulfur coal. In other applications, the present disclosure is applicable to noncombustible, contaminant-containing feed materials, including, without limitation, metal-containing ores, concentrates, and tailings.

The feed material 104 is combined with an additive 106 and thermal stability agent 110 to form an additive-containing feed material 108. The additive 106 and thermal stability agent 110 may be contacted with the feed material 104 concurrently or at different times. They may be contacted with one another and subsequently contacted with the feed material 104.

The additive-containing feed material 108 is heated in thermal unit 112 to produce a contaminated gas stream 116. The thermal unit 112 can be any heating device, including, without limitation, a dry or wet bottom furnace (e.g., a blast furnace, puddling furnace, reverberatory furnace, Bessemer converter, open hearth furnace, basic oxygen furnace, cyclone furnace, stoker boiler, cupola furnace, a fluidized bed furnace (e.g., a CFB), arch furnace, and other types of furnaces), boiler, incinerator (e.g., moving grate, fixed grate, rotary-kiln, or fluidized or fixed bed, incinerators), calciners including multi-hearth, suspension or fluidized bed roasters, intermittent or continuous kiln (e.g., ceramic kiln, intermittent or continuous wood-drying kiln, anagama kiln, bottle kiln, rotary kiln, catenary arch kiln, Feller kiln, noborigama kiln, or top hat kiln), or oven.

The contaminated gas stream 116 generally includes a number of contaminants. A common contaminated gas stream 108 includes (elemental and ionic) mercury, particulates (such as fly ash), sulfur oxides, nitrogen oxides, hydrochloric acid (HCl), other acid gases, carbon oxides, and unburned carbon.

The contaminated gas stream 116 is optionally passed through the air preheater 120 to transfer some of the thermal energy of the contaminated gas stream 116 to air 122 prior to input to the thermal unit 112. The heat transfer produces a common temperature drop in the contaminated gas stream 116 of from about 500° C. to about 300° C. to produce a cooled contaminated gas stream 124 temperature commonly ranging from about 100 to about 400° C.

The cooled contaminated gas stream 124 passes through a particulate control device 128 to remove most of the particulates (and targeted contaminant and/or derivatives thereof) from the cooled contaminated gas stream 124 and form a treated gas stream 132. The particulate control device 500 can be any suitable device, including a wet or dry electrostatic precipitator, particulate filter such as a baghouse, wet particulate scrubber, and other types of particulate removal device.

The treated gas stream 132 is emitted, via gas discharge (e.g., stack), into the environment.

The Additive

The additive depends on the particular targeted contaminant. Exemplary additives include halogens, halides, nitrogenous materials, activated carbon, lime, soda ash, and the like. While a variety of additives may be employed to remove or cause removal of a targeted contaminant, the additive typically causes removal of nitrogen oxides and other acid gases. A typical additive for removing or causing removal of nitrogen oxide is a nitrogenous material, commonly ammonia, an ammonia precursor (such as an amine (e.g., a melamine ($C_3H_3N_6$)), amide (e.g., a cyanamide ($CN_2H_2$)), and/or urea.

While not wishing to be bound by any theory, ammonia is believed to react with nitrogen oxides formed during the combustion of the feed material to yield gaseous nitrogen and water vapor according to the following global reaction:

$$2NO+2NH_3+\tfrac{1}{2}O_2 \rightarrow 2N_2+3H_2O \quad (1)$$

The optimal temperature range for Reaction (1) is from about 1550° F. to 2000° F. (843 to 1093° C.). Above 2000° F. (1093° C.), the nitrogeneous compounds from the ammonia precursor may be oxidized to form $NO_x$. Below 1550° F. (843° C.), the production of free radicals of ammonia and amines may be too slow for the global reaction to go to completion.

Without being bound by theory, an amine and/or amide can act as an ammonia precursor that, under the conditions in a thermal unit 112, thermally decomposes and/or undergoes a hydrolysis reaction to form ammonia gas, or possibly free radicals of ammonia ($NH_3$) and amines ($NH_2$) (herein referred to collectively as "ammonia").

Sources of amines or amides include any substance that, when heated, produces ammonia gas and/or free radicals of ammonia. Examples of such substances include, for example, urea, carbamide, polymeric methylene urea, animal waste, ammonia, methamine urea, cyanuric acid, and other compounds which can break down and form NH* or $NH_2$* radicals, and combinations and mixtures thereof. In an embodiment, the substance is urea. In an embodiment, the substance is animal waste. In yet other embodiments, granular long chain polymerized methylene ureas are used as additives, as the kinetics of thermal decomposition are expected to be relatively slower and therefore a larger fraction of unreacted material may still be available past the flame zone. The additive may further be any compound with an amine (e.g., $NH_2$) or amide functional group. Examples would include methyl amine, ethyl amine, butyl amine, etc.

The additive can contain a single substance for removing a targeted contaminant pollutant, or it can contain a mixture of such substances for targeting different contaminants, such as nitrogen oxides and elemental mercury. For example, the additive can contain a single substance including both an amine or amide for removing or causing removal of a nitrogen oxide and a halogen for removing or causing removal of elemental mercury. An example of such an additive is a haloamine formed by at least one halogen and at least one amine, a halamide formed by at least one halogen and at least one amide, or other organohalide including both an ammonia precursor and dissociable halogen. The precursor composition can contain a mixture of an amine and/or an amide, and a halogen.

In another embodiment, the additive will be added to the feed material along with a halogen component. Preferred methods for adding the halogen component are described in U.S. Pat. No. 8,372,362 and US 2012-0100053 A1, and US 2012-0216729 A1, each of which is incorporated herein by this reference. The halogen component may be added as an elemental halogen or a halogen precursor. Commonly, the halogen component is added to the feed material before combustion. The halogen may be added in slurry form or as a solid, including a halogen salt. In either form, the halogen may be added at the same time as, or separate from, the additive.

This list is non-exhaustive; the primary concerns are the chemical properties of the additive. A benefit of the amine and amide materials may be a slower decomposition rate, thus allowing ammonia generation to occur further downstream in the flow of the contaminated gas stream 108 than would be the case with urea and thus exposing the ammonia to less oxidation to NO than is seen with urea when introduced with the feed material to the thermal unit 112.

Commonly at least about 25%, more commonly at least most, more commonly at least about 75%, more commonly at least about 85% and even more commonly at least about 95% of the additive is added in liquid or solid form to the combustion feed material.

The additive can be formulated to withstand more effectively, compared to other forms of the additive, the thermal effects of combustion. In one formulation, at least most of the additive is added to the combustion feed material as a liquid, which is able to absorb into the matrix of the feed material. The additive will volatilize while the bulk of the feed material consumes a large fraction thermal energy that could otherwise thermally degrade the additive. The liquid formulation can include other components, such as a solvent (e.g., water surfactants, buffering agents and the like)), and a binder to adhere or bind the additive to the feed material, such as a wax or wax derivative, gum or gum derivative, and other inorganic and organic binders designed to disintegrate thermally during combustion (before substantial degradation of the additive occurs), thereby releasing the additive into the boiler or furnace freeboard, or into the off-gas.

In another formulation, at least most of the additive is added to the combustion feed material as a particulate. In this formulation, the particle size distribution ($P_{80}$ size) of the additive particles as added to the fuel commonly ranges from about 20 to about 6 mesh (Tyler), more commonly from about 14 to about 8 mesh (Tyler), and even more commonly from about 10 to about 8 mesh (Tyler).

The additive can be slurried or dissolved in the liquid formulation. A typical additive concentration in the liquid formulation ranges from about 20% to about 60%, more typically from about 35% to about 55%, and even more typically from about 45% to about 50%.

The Thermal Stability Agent

Despite the formulation of the additive to withstand the effects of combustion, the additive can still thermally degrade under the conditions in the thermal unit 112. When the additive-containing feed material is combusted for example, the additive can be thermally degraded, oxidized, or decomposed by the flame envelope. The thermal stability agent generally provides an encapsulation compound or heat sink that protects and delivers the additive through the flame envelope (and the intense chemical reactions occurring within the flame envelope), so that it survives in sufficient quantity to measurably affect contaminant (e.g., $NO_x$) emissions. As will be appreciated, the flame envelope in the thermal unit 112 typically has a temperature in excess of 2,000° F. (1093° C.).

The thermal stability agent can be a metal or metal-containing compound, such as an alkaline earth metal or alkaline earth metal-containing compound, particularly a hydroxide or carbonate or bicarbonate. Commonly, the thermal stability agent is an alkaline earth metal-containing hydroxide or carbonate, such as magnesium hydroxide or magnesium carbonate. While not wishing to be bound by any theory, it is believed that, in the combustion process, the metal hydroxide (e.g., magnesium hydroxide) or carbonate (e.g., magnesium carbonate) or metal bicarbonate calcines to a metal oxide (e.g., MgO) in an endothermic reaction. The reaction in effect creates a localized heat sink. Therefore, when mixed thoroughly with the additive (e.g., urea) the reaction product creates a heat shield, absorbing heat from the furnace flame zone or envelope in the localized area of the additive molecules. This can allow the additive to survive in sufficient quantity to target the selected contaminant (e.g., $NO_x$) downstream of the thermal unit 112.

A common additive mixture comprises the additive, namely urea, and the thermal stability agent, namely magnesium hydroxide or carbonate. The primary active components of the additive mixture are urea and magnesium hydroxide or carbonate.

The additive mixture may not only comprise the additive and the thermal stability agent as separate components but also comprise the additive and thermal stability agent as part of a common chemical compound. For example, the mixture may comprise a metal cyanamide (e.g., an alkaline earth metal cyanamide such as calcium cyanamide (e.g., $CaCN_2$)) and/or a metal nitride (e.g., an alkaline earth metal nitride such as calcium nitride (e.g., $Ca_3N_2$)). The metal cyanamide or nitride can, depending on temperature, produce not only ammonia but also a particulate metal oxide or carbonate. Metal cyanamide, in particular, can proceed through intermediate cyanamide via hydrolysis and then onto urea formation with further hydrolysis. It may therefore offer a substantial degree of delay in urea release for subsequent ammonia production in the contaminated gas stream 108, which can be a substantial benefit relative to the additive alone.

As will be appreciated, calcium and other alkaline earth materials can perform similarly to magnesium oxide. Furthermore, any metal hydrate or hydroxide mineral can also be suitable as this family of minerals can decompose endothermically to provide the necessary sacrificial heat shield to promote survival of the additive (particularly nitrogenous materials) out of the flame envelope.

Commonly, the molar ratio of the thermal stability agent: additive ranges from about 1:1 to about 10:1, more commonly from about 1:1 to about 8:1 and even more commonly from about 1.5:1 to about 5:1.

The additive mixture can be added to the feed material either as a solid or as a slurry. Commonly, the additive mixture is added to the feed material prior to combustion. Under normal operating conditions, the additive mixture will be applied on the feed belt shortly before combustion. However, the additive mixture may be mixed with the feed material, either all at once or with the individual components added at different times, at a remote location.

Another thermal stability agent formulation comprises a thermally stable substrate matrix, other than the feed material particles, to protect the additive through the flame combustion zone or envelope. Exemplary thermally stable substrates to support the nitrogenous component include zeolites (or other porous metal silicate materials), clays, activated carbon (e.g., powdered, granular, extruded, bead, impregnated, and/or polymer coated activated carbon), char, graphite, ash (e.g., (fly) ash and (bottom) ash), metals, metal oxides, and the like.

The thermal stability agent formulation can include other components, such as a solvent (e.g., water surfactants, buffering agents and the like)), and a binder to adhere or bind the additive to the substrate, such as a wax or wax derivative, gum or gum derivative, alkaline binding agents (e.g., alkali or alkaline earth metal hydroxides, carbonates, or bicarbonates, such as lime, limestone, caustic soda, and/or trona), and/or other inorganic and organic binders designed to disintegrate thermally during combustion (before substantial degradation of the additive occurs), thereby releasing the additive into the boiler or furnace freeboard, or into the off-gas.

Figure 2:
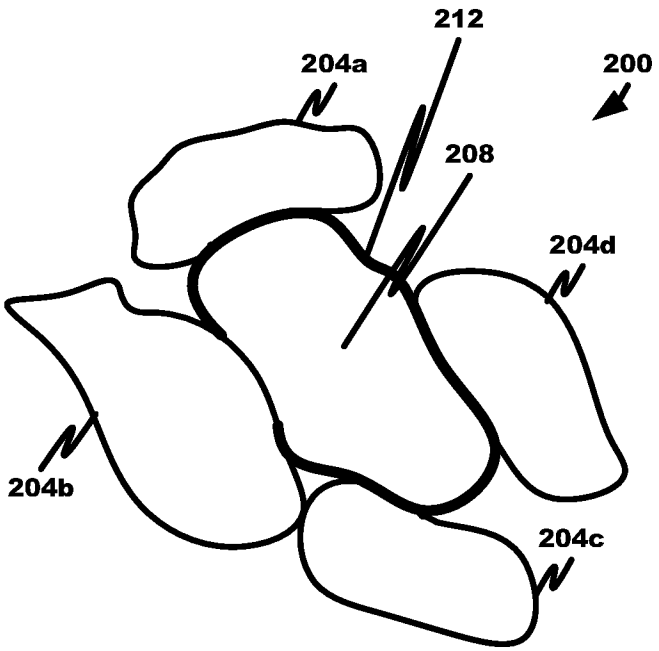
FIG. 2 is a thermal stability agent formulation according to an embodiment.

A thermal stability agent formulation 200 is shown in FIG. 2. The formulation 200 includes thermal stability agent particles 204*a-d* bound to and substantially surrounding an additive particle 208. The formulation can include a binder 212 to adhere the various particles together with sufficient strength to withstand contact with the feed material 104 and subsequent handling and transporting to the thermal unit 112. As can be seen from FIG. 2, the thermal stability agent particles 204*a-d* can form a thermally protective wall, or a surface contact heat sink, around the additive particle 208 to absorb thermal energy sufficiently for the additive particle 208 to survive combustion conditions in the thermal unit 112. The thermal stability agent formulation 200 is typically formed, or premixed, prior to contact with the feed material 104.

A common thermal stability agent formulation to deliver sufficient NOx reducing additive to the post-flame zone for NOx and/or other contaminant removal incorporates the additive into a fly ash matrix combined with one or more alkaline binding agents, such as an alkali or alkaline earth metal hydroxide (e.g., lime, limestone, and sodium hydroxide) and alkali and alkaline earth metal carbonates and bicarbonates (e.g., trona (trisodium hydrogendicarbonate dihydrate or $Na_3(CO_3)(HCO_3).2H_2O$)). This formulation can provide the additive with adequate protection from the heat of the combustion zone, reduce mass transfer of oxygen and combustion radicals which would break down the additive, and deliver sufficient quantities of the additive reagent to the post-flame zone to measurably reduce NOx and/or other contaminant emissions.

Other granular urea additives with binder may also be employed.

The additive can be mixed with substrate (e.g., fly ash) and alkaline binder(s) to form a macroporous and/or microporous matrix in which the additive becomes an integral part of the substrate matrix to form the additive mixture. The composition of the additive mixture can be such that the additive acts as a binding agent for the substrate, and it is theorized that the substrate can protect the additive from the intense heat and reactions of the flame envelope. The matrix can act as a porous structure with many small critical orifices. The orifices effectively serve as a "molecular sieve," limiting the rate at which the additive is able to escape from the matrix. The matrix acts as a heat shield, allowing for survival of the additive trapped within the matrix through the flame envelope. Properly designed, the porous matrix structure can ensure that sufficient additive arrives in the cooler flue gas zones in sufficient quantities to measurably reduce $NO_x$ and/or other contaminant levels.

Ash as an additive substrate can have advantages. Because the fly ash already went through a combustion cycle, it readily moves through the flame zone and the rest of the boiler/combustor/steam generating plant without adverse affects. Via the fly ash and alkaline stabilizer matrix, an additive can arrive in the fuel rich zone between the flame envelope and over-fire air where it is introduced, for example, to $NO_x$ molecules and can facilitate their reduction to $N_2$. In addition, in units with short gas phase residence time, the additive is designed to survive through the entire combustion process including passing through the over-fire air, if in use at a particular generating station, to introduce the additive (e.g., nitrogen containing NOx reducing agent) into the upper furnace, which is the traditional SNCR injection location. If used in operations where staged combustion is not employed, the additive is designed to survive the combustion zone and reduce NOx in the upper furnace.

The relative amounts of additive, substrate and binder depend on the application. Typically, the additive mixture comprises from about 10 to about 90 wt. %, more typically from about 20 to about 80 wt. %, and even more typically from about 30 to about 70 wt. % additive (dry weight), from about 90 to about 10 wt. %, more typically from about 80 to about 20 wt. %, and even more typically from about 70 to about 30 wt. % substrate (dry weight), and from about 0 to about 5 wt. %, more typically from about 0.1 to about 3 wt. %, and even more typically from about 0.2 to about 2 wt. % binder (dry weight). As noted, the binder is optional; therefore, it can be omitted in other additive mixture formulations.

Various methods are also envisioned for generating an additive mixture of the additive and the thermal stability agent. In one example, the substrate (e.g., recycled ash) is mixed with a liquid additive. The additive mixture then may be added to the feed material as a slurry or sludge, or as a solid matrix with varying amounts of residual moisture. In yet another aspect, the additive mixture is created by applying a liquid additive (e.g., ammonia or urea) to the substrate (e.g., recycled fly ash). The liquid additive can be introduced by dripping onto the substrate. The substrate might be presented by recycling captured fly ash or by introducing in bulk in advance of the combustion source. After applying the additive, the additive mixture is pressed into a brick or wafer. A range of sizes and shapes can function well. The shape and size of an additive mixture particle added to the feed material can be designed based on thermal unit 112 design to optimize the delivery of the additive in the thermal unit based upon the fluid dynamics present in a particular application.

In another example, the feed material is first treated by adding the substrate with the additive. Once treated, the feed material is transported and handled in the same way as untreated feed material. In power plants for example, coal pretreated with the additive mixture may be stored in a bunker, fed through a pulverizer, and then fed to the burners for combustion. During combustion, a fuel-rich environment may be created to facilitate sufficient additive survival through the flame envelope so that the additive may be mixed with and react with NOx or other targeted contaminant either in the fuel-rich zone between the burners and over fire air or in the upper thermal unit 112 depending upon the gas phase residence times within the thermal unit 112. Alternatively, the additive-containing feed material may be burned in a fuel-lean combustion condition, with the substrate matrix providing enough mass transfer inhibition such that the additive is not consumed during the flame envelope.

The following combinations and ratios of chemicals have demonstrated a high degree of thermal stability. This list is not exhaustive but rather is simply illustrative of various combinations that have shown favorable characteristics.

Fly Ash/Urea, wherein Urea is added as about a 35-40% solution in water to the fly ash. No other water is added to the mixture. The evaluated combination included 1,500 g Powder River Basin "PRB" fly ash, approximately 400 grams urea, and 600 mL water.

Fly Ash/Urea with Ca/Na, comprising: 1,500 g PRB fly ash, approximately 400 grams urea from urea solution, 300 grams NaOH, and CaO at a 1:1 molar ratio and 15% of total using hydrated lime.

Fly Ash/Urea/methylene urea, comprising: 1,500 g PRB fly ash, 300 grams powder methylene urea, and 80 grams urea from solution.

Fly Ash/Urea/Lime, comprising: 1,500 gm PRB fly ash, approximately 400 grams urea from urea solution, additional lime added (approximately 200 grams).

As will be appreciated, substrates other than fly ash, additives other than urea, and binders other than lime can be used in the above formulations.

In other formulations, the additive is combined with other chemicals to improve handing characteristics and/or support the desired reactions and/or inhibit thermal decomposition of the additive. For example, the additive, particularly solid amines or amides, whether supported or unsupported, may be encapsulated with a coating to alter flow properties or provide some protection to the materials against thermal decomposition in the combustion zone. Examples of such coatings include silanes, siloxanes, organosilanes, amorphous silica or clays.

In any of the above formulations, other thermally adsorbing materials may be applied to substantially inhibit or decrease the amount of nitrogenous component that degrades thermally during combustion. Such thermally adsorbing materials include, for example, amines and/or amides other than urea (e.g., monomethylamine and alternative reagent liquids).

The additive mixture can be in the form of a solid additive. It may be applied to a coal feed, pre-combustion, in the form of a solid additive. A common ratio in the additive mixture is from about one part thermal stability agent to one part additive to about four parts thermal stability agent to one part additive and more commonly from about 1.5 parts thermal stability agent to one part additive to about 2.50 parts thermal stability agent to one part additive.

Urea, a commonly used additive, is typically manufactured in a solid form in the form of prills. The process of manufacturing prills is well known in the art. Generally, the prills are formed by dripping urea through a "grate" for sizing, and allowing the dripped compound to dry. Prills commonly range in size from 1 mm to 4 mm and consist substantially of urea.

To form the additive mixture, the thermal stability agent (e.g., magnesium hydroxide fines or particles) can be mixed with the urea prior to the prilling process. Due to the added solid concentration in the urea prill, an additional stabilizing agent may be required. A preferred stabilizing agent is an alkaline earth metal oxide, such as calcium oxide (CaO), though other stabilizing agents known in the art could be used. The stabilizing agent is present in low levels—approximately 1% by weight—and is added prior to the prilling process. The additive created by this process is a prill with ratios of about 66 wt. % thermal stability agent (e.g., magnesium hydroxide), about 33 wt. % additive (e.g., urea), and about 1 wt. % stabilizing agent.

Once stabilized in prill form, the additive mixture may easily be transported to a plant for use. As disclosed in prior work, the prills are mixed in with the feed material at the desired weight ratio prior to combustion.

The thermal stability agent can be in the form of a liquid or slurry when contacted with the additive, thereby producing an additive mixture in the form of a liquid or slurry. For example, a magnesium hydroxide slurry was tested. This formulation was tested partly for the decomposition to MgO and to evaluate if it might help to slightly lower temperatures in the primary flame zone due to slurry moisture and endothermic decomposition. This formulation is relatively inexpensive and has proven safe in boiler injection. The formulation was made by blending a $Mg(OH)_2$ slurry with urea and spraying on the coal, adding only about 1 to 2% moisture. Generally, when added in liquid or slurry form the additive mixture includes a dispersant. Any commonly used dispersant may be used; a present preferred dispersant is an alkali metal (e.g., sodium) lignosulfonate. When applied in slurry form, ratios are approximately 40 wt. % thermal stability agent (e.g., magnesium hydroxide), 20 wt. % additive (e.g., urea), 39 wt. % water, and 1 wt. % dispersant. This can actually involve the determination of two ratios independently. First, the ratio of thermal stability agent to additive [Mg(OH)2:Urea] is determined. This ratio typically runs from about 0.5:1 to 8:1, and more typically is about 2:1. With that ratio established, the ratio of water to additive [H2O:urea] can be determined. That ratio again runs typically from about 0.5:1 to 8:1, and more typically is about 2:1. The slurry is typically applied onto the coal feed shortly before combustion.

An alternative approach to a thermal stability agent, not involving a thermal stabilizing agent, utilizes a radical scavenger approach to reduce NOx by introducing materials to scavenge radicals (e.g., OH, O) to limit NO formation. Thermal $NO_x$ formation is governed by highly temperature-dependent chemical reactions provided by the extended Zeldovich mechanism:

$$O+N_2 \leftrightarrow N+NO$$

$$N+O_2 \leftrightarrow O+NO$$

$$N+OH \leftrightarrow H+NO$$

Examples of materials that can reduce $NO_x$ per the proposed radical scavenger method include alkali metal carbonates and bicarbonates (such as sodium bicarbonate, sodium carbonate, and potassium bicarbonate), alkali metal hydroxides (such as sodium hydroxide and potassium hydroxide), other dissociable forms of alkali metals (such as sodium and potassium), and various forms of iron including FeO, $Fe_2O_3$, $Fe_3O_4$, and $FeCl_2$. Sources of iron for the thermal stabilizing agent include BOF dust, mill fines, and other wastes. Engineered fine iron particle and lab grade products may also be utilized. Representative sources would include ADA-249™ and ADA's patented Cyclean™ technology, and additives discussed more fully in U.S. Pat. Nos. 6,729,248, 6,773,471, 7,332,002, 8,124,036, and 8,293,196, each of which are incorporated herein by this reference.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

Example 1

The additive was applied to the coal simply by adding the additive to a barrel of pulverized coal and mixing to simulate the mixing and sizing that would occur as the coal passed through a pulverizer at a full scale unit. The treated fuel was fed to the boiler at 20 lbs per hour, at combustion temperatures which exceeded 2000° F. in a combustion environment that consisted of burners. This configuration demonstrated up to a 23% reduction in NOx, as measured by a Thermo Scientific NOX analyzer.

Slurried additive mixtures comprising magnesium hydroxide and urea solution were evaluated in a pilot tangentially-fired coal combustor. The additive mixture was added to coal as slurry, which in practice could be accomplished either individually or in combination, prior to combustion.

Coal was metered into the furnace via four corner-located coal feeders at the bottom of the furnace. Combustion air and overfire air were added at a controlled rate measured by electronic mass flow controllers. The combustor exit oxygen concentration was maintained within a narrow range, targeted at the identical oxygen for both baseline and while firing treated coal. Tests were maintained at stable combustion with batched coal feed for at least 3 hours or longer. A flue gas sample was extracted from the downstream gas duct after a particulate control device (fabric filter or electrostatic precipitator) in order to measure $NO_x$ and other vapor constituents in an extractive continuous emission monitor. The gas was sampled through an inertial separation probe (QSIS probe), further eliminating interference from particulate or moisture. $NO_x$ concentration was measured dry basis with a Thermo-Electron chemiluminescent $NO_x$ monitor. The measured concentration was corrected to constant oxygen and expressed in units of lbs/MMBtu. Percent reduction was calculated from the average baseline and the average with treated coal for a given combustion condition.

As disclosed in Table 1 below, a slurried additive mixture comprising 0.10 wt. % urea and 0.60 wt. % magnesium hydroxide (by weight of coal) yielded a 21.5% reduction in $NO_x$ as compared to the baseline condition.

A second additive mixture comprising 0.25 wt. % urea and 0.25 wt. % magnesium hydroxide (by weight of coal) yielded a 13.7% reduction in $NO_x$ as compared to the baseline condition.

Pilot testing also was conducted with melamine as the additive in place of urea. In a tested condition, an additive mixture comprising 0.10 wt. % melamine and 0.50 wt. % magnesium hydroxide (by weight of coal) was added to the coal. While a 2.4% reduction in $NO_x$ was achieved with this additive, the $NO_x$ reduction was lower than that of the urea-containing additives.

Example 2

Another series of tests were conducted at the same pilot combustor with further optimized additive rates and different PRB coal, using the same procedures. Table 2 summarizes the results. With magnesium hydroxide at 0.4 wt. % by weight of coal and urea at 0.2 wt. % by weight of coal produced 21% $NO_x$ reduction. Further refinement produced 22-23% $NO_x$ reduction with 0.3 wt. % by weight magnesium hydroxide and 0.15 wt. % urea (by weight of coal). This reduction has also been achieved with 0.25% by weight Mg(OH)2 and 0.125% by weight urea in other tests.

TABLE 1

| Condition | Urea (% of coal feed) | Mg Hydroxide (% of coal feed) | Melamine (% of coal feed) | Baseline NOx (lbs/MMBtu) | Test NOx (lbs/MMBtu) | Reduction from Baseline (%) |
|---|---|---|---|---|---|---|
| Test 1 | 0.25 | 0.25 | 0 | 0.41 | 0.39 | 5.5 |
| Test 2 | 0.25 | 0.25 | 0 | 0.46 | 0.40 | 13.7 |
| Test 2a | 0.10 | 0.60 | 0 | 0.46 | 0.36 | 21.7 |
| Test 3 | 0 | 0.50 | 0.10 | 0.46 | 0.45 | 2.4 |
| Test 3a | 0.10 | 0.20 | 0 | 0.46 | 0.44 | 4.9 |

TABLE II

| Condition | Urea (% of coal feed) | Mg Hydroxide (% of coal feed) | Baseline NOx (lbs/MMBtu) | Test NOx (lbs/MMBtu) | Reduction from Baseline (%) |
|---|---|---|---|---|---|
| Test 4 | 0.10 | 0.60 | 0.46 | 0.41 | 10% |
| Test 5 | 0.20 | 0.40 | 0.46 | 0.36 | 21% |
| Test 6 | 0.15 | 0.30 | 0.46 | 0.35 | 23% |
| Test 7 | 0.15 | 0.30 | 0.46 | 0.36 | 22% |

Example 3

Earlier testing conducted at the same tangentially-fired pilot combustion facility firing PRB coal evaluated a variety of additive materials comprising a nitrogenous additive formulated in a heat resistant solid matrix. The additives were evaluated at a number of combustion air-fuel conditions ranging from very low excess air (stoichiometric ratio, SR, of 0.7) to a condition close to unstaged combustion (SR 0.92 to 1), Tests with low excess air did not achieve any additional $NO_x$ reduction. Tests at more normal excess air (SR=0.92 to 1) did show consistent reduction of $NO_x$ with both a nitrogenous reducing additive (urea) and with iron oxides. A detailed chart of tested materials is disclosed below. In the tested examples, BOF dust was comprised of a mix of iron oxides, Fe(II) and Fe(III), $Fe(II)Cl_2$, $Fe_2O_3$, and $Fe_3O_4$. A mixed solid labeled UFA was comprised of a powderized solid of coal fly ash and urea with lime binder. Powderized sodium bicarbonate (SBC) was also added. The additive, thermal stabilizing and binder materials were finely powderized and thoroughly mixed with coal in batches prior to combustion. As can be seen from the table, none of the tests were as successful as urea and magnesium hydroxide.

TABLE III

| Test # | Combustion Condition (Air-Fuel SR) | UFA (% of coal feed) | Urea (% of coal feed) | Iron Oxides (% of coal feed) | SBC (ppm of coal feed) | Baseline NOx (lbs/MMBtu) | Test NOx (lbs/MMBtu) | NOx Reduction (%) |
|---|---|---|---|---|---|---|---|---|
| 1-2 | 0.7 | 2.5% | 0.5% | 0.5% | 1300 | 0.27 | 0.272 | −0.74% |
| 1-3 | 0.78 | 2.5% | 0.5% | 0.5% | 1300 | 0.318 | 0.361 | −13.52% |
| 1-5 | 0.92 | 2.5% | 0.5% | 0.5% | 1300 | 0.679 | 0.624 | 8.10% |
| 2-2 | 0.7 | 0.0% | 0.0% | 0.5% | 700 | 0.27 | 0.274 | −1.48% |
| 2-3 | 0.78 | 0.0% | 0.0% | 0.5% | 700 | 0.318 | 0.323 | −1.57% |
| 2-5 | 0.92 | 0.0% | 0.0% | 0.5% | 700 | 0.679 | 0.574 | 15.46% |
| 3-2 | 0.7 | 2.5% | 0.5% | 0.0% | 1300 | 0.27 | 0.259 | 4.07% |
| 3-3 | 0.78 | 2.5% | 0.5% | 0.0% | 1300 | 0.318 | 0.33 | −3.77% |
| 3-5 | 0.92 | 2.5% | 0.5% | 0.0% | 1300 | 0.679 | 0.633 | 6.77% |

Example 4

NOx reduction tests were also performed at a second pulverized coal pilot facility with a single burner configured to simulate a wall fired boiler. During these tests, a slurry comprising 0.3% by weight of coal of $Mg(OH)_2$ and 0.15% of urea on the coal was tested under staged combustion conditions. The results show that under practical combustion burner stoichiometric ratios, NOx reductions in excess of 20% can be achieved in a second unit designed to represent wall fired pulverized coal boilers.

TABLE IV

| Fuel Identification: Powder River Basin | | | | | | |
|---|---|---|---|---|---|---|
| | | $NO_x$ Results | | | | |
| | BSR | $O_2$, % | $NO_x$, ppm | $NO_x$, ppm corrected to 3.50% $O_2$ | $NO_x$, lb/MMBtu | $NO_x$ Reduction, % |
| Feedstock | 0.75 | 4.21 | 143 | 149 | 0.207 | — |
| Refined 3 | 0.75 | 4.22 | 109 | 113 | 0.157 | 24.15 |
| Feedstock | 0.85 | 4.04 | 152 | 157 | 0.216 | — |
| Refined 3 | 0.85 | 4.00 | 119 | 123 | 0.171 | 20.83 |

The foregoing discussion of the invention has been presented for purposes of illustration and description, and is not intended to limit the invention to the form or forms disclosed herein. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

A number of variations and modifications of the disclosure can be used. It would be possible to provide for some features of the disclosure without providing others.

For example, in one alternative embodiment, any of the above methods, or any combination of the same, can be combined with activated carbon injection for mercury and NOx control. The activated carbon may be combined with halogens, either before or during injection.

In another embodiment, any of the above methods, or any combination of the same, can be combined with dry sorbent injection (DSI) technology. Other sorbent injection combinations, particularly those used in conjunction with halogen injection, are disclosed in Publication US-2012-0100053-A1, which is incorporated herein by this reference.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A composition, comprising:

a nitrogenous material comprising one or more of ammonia and an ammonia precursor;

a binder; and a thermal stability agent comprising one or more of a metal hydroxide, a metal carbonate, a metal bicarbonate, and ash, wherein:

the thermal stability agent is bound by the binder to the nitrogenous material, and a molar ratio of the thermal stability agent to the nitrogenous material ranges from about 1:1 to about 10:1.

2. The composition of claim 1, wherein the thermal stability agent comprises the metal hydroxide and wherein the ammonia precursor is a compound that thermally decomposes or hydrolyzes to form one or more of ammonia gas, free radicals of ammonia, and amines.

3. The composition of claim 1, wherein the thermal stability agent comprises the metal carbonate and wherein the ammonia precursor is one or more of an amine, an amide, cyanuric acid, a nitride, and a urea.

4. The composition of claim 1, wherein the thermal stability agent comprises the metal bicarbonate and wherein the molar ratio of the thermal stability agent to the nitrogenous material ranges from about 0.5:1 to about 2:1.

5. The composition of claim 1, wherein the thermal stability agent comprises the ash.

6. The composition of claim 1, wherein the nitrogenous material comprises the ammonia and wherein the thermal stability agent forms, when the composition is combusted, one or more of a thermally protective barrier and a heat sink around the nitrogenous material to reduce thermal degradation of the nitrogenous material.

7. The composition of claim 1, wherein the nitrogenous material comprises the ammonia precursor, wherein the nitrogenous material is in the form of particles having an exterior surface, and wherein the thermal stability agent is in contact with some, but not all of the exterior surface of the nitrogenous material particles.

8. The composition of claim 1, wherein the nitrogenous material is in the form of particles having an exterior surface, and wherein the thermal stability agent is bound to and substantially surrounds the exterior surface of the nitrogenous material particles.

9. The composition of claim 1, wherein the thermal stability agent comprises an alkali metal, an alkaline earth metal, or both.

10. The composition of claim 1, wherein the thermal stability agent comprises calcium, magnesium, or both.

11. The composition of claim 1, wherein the nitrogenous material is in the form of particles having a particle size distribution ($P_{80}$) from about 20 to about 6 mesh (Tyler), wherein the nitrogenous material further comprise a substrate, and wherein the substrate is a porous matrix comprising one or more of zeolite, char, graphite, and ash.

12. The composition of claim 1, wherein the binder is one or more of a wax, a wax derivative, a gum, a gum derivative, and an alkaline binding agent.

13. The composition of claim 1, further comprising coal, wherein the coal is one or more of a high alkali coal, a high iron coal, and a high sulfur coal.

14. The composition of claim 1, further comprising a halogen compound.

15. The composition of claim 1, wherein the composition is in the form of one or more of a slurry, a sludge, and a solution.

16. A composition, comprising:

a nitrogenous material comprising one or more of ammonia, an amine, an amide, cyanuric acid, a nitride, and a urea; and a thermal stability agent comprising one or more of a metal hydroxide, a metal carbonate, a metal bicarbonate, and ash, wherein the thermal stability agent is bound to and substantially surrounds the nitrogenous material and forms, when the composition is combusted, one or more of a thermally protective barrier and a heat sink around the nitrogenous material to reduce thermal degradation of the nitrogenous material, and wherein a molar ratio of the thermal stability agent to the nitrogenous material ranges from about 1:1 to about 10:1.

17. The composition of claim 16, further comprising a binder, wherein the binder is one or more of a wax, a wax derivative, a gum, a gum derivative, and an alkaline binding agent.

18. The composition of claim 16, wherein the molar ratio of the thermal stability agent to the nitrogenous material ranges from about 0.5:1 to about 2:1.

19. The composition of claim 16, wherein the thermal stability agent comprises one or more of an alkaline earth metal hydroxide, an alkaline earth metal carbonate, and an alkaline earth metal bicarbonate and wherein the thermal stability agent comprises calcium, magnesium, or both.

20. A composition, comprising:

a nitrogenous material comprising one or more of ammonia, an amine, an amide, cyanuric acid, a nitride, and a urea;

a binder; and a thermal stability agent comprising one or more of an alkali metal hydroxide, an alkali metal carbonate, an alkali metal bicarbonate, an alkaline earth metal hydroxide, an alkaline earth metal carbonate, and an alkaline earth metal bicarbonate, wherein a molar ratio of the thermal stability agent to the nitrogenous material ranges from about 1:1 to about 10:1.

21. The composition of claim 20, wherein the nitrogenous material is in the form of particles having an exterior surface, and wherein the thermal stability agent is in contact with some, but not all of the exterior surface of the nitrogenous material particles.

22. The composition of claim 20, wherein the nitrogenous material is in the form of particles having an exterior surface, and wherein the thermal stability agent is bound to and substantially surrounds the exterior surface of the nitrogenous material particles.

23. The composition of claim 20, wherein the thermal stability agent comprises one or more of the alkaline earth metal hydroxide, the alkaline earth metal carbonate, and the alkaline earth metal bicarbonate and wherein the thermal stability agent comprises calcium, magnesium, or both.

24. The composition of claim 20, wherein the binder is one or more of a wax, a wax derivative, a gum, a gum derivative, and an alkaline binding agent.

* * * * *